US007310486B2

(12) United States Patent
Kawazu et al.

(10) Patent No.: US 7,310,486 B2
(45) Date of Patent: Dec. 18, 2007

(54) POWER SUPPLY APPARATUS AND HEATING APPARATUS AND IMAGE FORMING APPARATUS

(75) Inventors: Takao Kawazu, Numazu (JP); Atsuya Takahashi, Mishima (JP); Masataka Mochizuki, Numazu (JP); Hiroshi Chihara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 210 days.

(21) Appl. No.: 11/255,102

(22) Filed: Oct. 21, 2005

(65) Prior Publication Data

US 2006/0093388 A1 May 4, 2006

(30) Foreign Application Priority Data

Oct. 29, 2004 (JP) ..... 2004-317062

(51) Int. Cl.
*G03G 15/00* (2006.01)
*G03G 15/20* (2006.01)

(52) U.S. Cl. ..... 399/69; 219/216; 399/88

(58) Field of Classification Search ..... 399/69, 399/67, 88, 33, 37; 219/216, 490, 497; 323/234, 323/235

See application file for complete search history.

(56) References Cited

U.S. PATENT DOCUMENTS

| | | | | |
|---|---|---|---|---|
| 5,149,941 | A | 9/1992 | Hirabayashi et al. | 219/216 |
| 5,262,834 | A | 11/1993 | Kusaka et al. | 399/329 |
| 2002/0014876 | A1* | 2/2002 | Han et al. | 318/729 |
| 2004/0146311 | A1* | 7/2004 | Kawazu et al. | 399/69 X |
| 2005/0169659 | A1* | 8/2005 | Koyama et al. | 399/88 |
| 2006/0093388 | A1 | 5/2006 | Kawazu et al. | 399/69 |

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |

(Continued)

*Primary Examiner*—Sophia S. Chen
(74) *Attorney, Agent, or Firm*—Fitzpatrick, Cella, Harper & Scinto

(57) ABSTRACT

A period of a first edge, a voltage change in a first direction of a first pulse signal fed from a zero-crossing detecting circuit, is detected. A second edge, a voltage change in a second direction opposite to the first direction, is generated when a time period equal to half the period of the first edge has elapsed from the next first edge. In response to a second pulse signal generated from the first and second edges, phase control of power to be supplied to heating elements is performed by using triacs. In this manner, during power control using a signal from the zero-crossing detecting circuit as a trigger signal, is achieved stable power control which enables tracking even though the power supply frequency fluctuates, and which is impervious to the effect of the positive or negative polarity of an input power supply.

11 Claims, 14 Drawing Sheets

FOREIGN PATENT DOCUMENTS

| | | |
|---|---|---|
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 10-10922 | 1/1998 |
| JP | 11-338304 | 12/1999 |
| JP | 2000-322137 | 11/2000 |
| JP | 2004-13668 | 1/2004 |
| JP | 2004-157659 | 6/2004 |

* cited by examiner

POWER SUPPLY APPARATUS AND HEATING APPARATUS AND IMAGE FORMING APPARATUS

BACKGROUND OF THE INVENTION

1. Field of the Invention

The present invention relates to a power supply apparatus and heating apparatus and image forming apparatus More specifically, the present invention relates to a system for controlling supplied power using a zero-crossing signal as a trigger, and particularly to a heating apparatus for fusing a toner image generated by electrophotographic process on a recording medium, and to an image forming apparatus having the heating apparatus.

2. Description of the Related Art

Conventionally, an image forming apparatus using electrophotographic process has been known. The image forming apparatus fuses an unfixed image (toner image) formed on transfer paper through image forming means such as electrophotographic process on the transfer paper with a heat fuser. As heat fusers, such heat fusers as described in References 1-16 are known: they include a heat roller type heat fuser using a halogen heater as its heat source, or a film heating type heat fuser using a ceramic face heater as its heat source. As for the References, they will be enumerated below.

Generally, power is fed to these heaters from an AC power supply via switching devices such as triacs.

In the fuser using the halogen heater as its heat source, the temperature of the fuser is detected by a temperature detecting device such as a thermistor. In response to the temperature detected, a sequence controller carries out the ON/OFF control of the switching devices, that is, the ON/OFF control of supplying power to the halogen heater, thereby performing the temperature control in such a manner that the temperature of the fuser becomes a target temperature.

On the other hand, the fuser using the ceramic face heater as its heat source utilizes the temperature difference between the temperature detected by the temperature detecting device and a preset target temperature. More specifically, a sequence controller applies the temperature difference between the temperature detected by the temperature detecting device and the preset target temperature to a PI or PID control formula, thereby calculating a manipulated variable. The manipulated variable is a power ratio to be supplied to the ceramic face heater. From the power ratio calculated, the corresponding phase angle or wave number is determined. Then, according to the phase or wave number determined, the switching devices undergo the ON/OFF control, thereby controlling the temperature of the fuser.

To achieve the phase control, it is necessary to inform the sequence controller of the zero-crossing signal which is the trigger signal of the phase control as proposed by the References 17-21, for example. The zero-crossing signal refers to a pulse signal that has a rising or falling edge occurring at the timing corresponding to the zero-crossing point at which the AC input power supply changes its polarity. In other words, the zero-crossing signal is generated by detecting the zero-crossing points at which the AC input power supply changes its polarity from positive to negative or vice versa. Alternatively, the zero-crossing signal is generated by detecting that the voltage of the AC input power supply falls below a certain threshold voltage including the zero-crossing point. The zero-crossing signal is delivered to the sequence controller. After the time period corresponding to a determined phase angle has elapsed from the edge of the zero-crossing signal which is the pulse signal, the sequence controller turns on and off the switching devices, thereby carrying out the ON/OFF control at the specified phase angle.

The heat roller fusing type heat fuser has as its basic structure a heat roller (fusing roller) serving as a heating rotator and an elastic press roller serving as a pressing rotator pressed to the heat roller. The heat roller fusing type heat fuser rotates the pair of rollers so that a recording medium serving as heated material on which an unfixed image (toner image) is formed and supported is introduced into and passed through the pressing nip portion (fusing nip portion) between the pair of the rollers. As the recording medium, a sheet, dielectric-coated paper, electrofax paper and printing paper are known. In this way, the heat roller fusing type heat fuser fixes by heat and pressure the unfixed image on the recording medium by the heat from the surface of the heat roller and the pressure of the pressing nip portion as a permanently fused image.

As for the film heat type heat fusers (on-demand fusers), they are proposed by the References 1, 2, 3 and 12. These on-demand fusers bring a heat resistant film (fusing film), which is a rotator for heating, into intimate contact with a heater element with a pressing rotator (elastic roller) to transport the film with sliding. Subsequently, the on-demand fuser introduces the recording medium that carries the unfixed image into the pressing nip portion formed by the heater element and the pressing rotator with sandwiching the heat resistant fusing film, thereby transporting the unfixed image together with the heat resistant film. Then, the on-demand fuser fuses the unfixed image on the recording medium as a permanent image by the heat from the heater element fed via the heat resistant film and the pressure at the pressing nip portion.

The film heat type heating apparatus can use a low heat capacity linear heater element as its heater element, and can use a low heat capacity thin film as its film. Thus, the film heat type heating apparatus can reduce power consumption and wait time (achieve quick start). In addition, as the film driving method of the film heat type heating apparatus, the following methods have been known: a method of providing a driving roller inside the film; and a method of driving the film using the frictional force between the film and the pressing rotator used as the driving roller. Recently, the pressing rotator driving system has been used more often because it can reduce the number of components and cost.

LIST OF REFERENCES

[Reference 1]
Japanese patent application laid-open No. 63-313182 (1988)

[Reference 2]
Japanese patent application laid-open No. 2-157878 (1990)

[Reference 3]
Japanese patent application laid-open No. 4-44075 (1992)

[Reference 4]
Japanese patent application laid-open No. 4-44076 (1992)

[Reference 5]
Japanese patent application laid-open No. 4-44077 (1992)

[Reference 6]
Japanese patent application laid-open No. 4-44078 (1992)

[Reference 7]
Japanese patent application laid-open No. 4-44079 (1992)

[Reference 8]
Japanese patent application laid-open No. 4-44080 (1992)

[Reference 9]
Japanese patent application laid-open No. 4-44081 (1992)

[Reference 10]
Japanese patent application laid-open No. 4-44082 (1992)

[Reference 11]
Japanese patent application laid-open No. 4-44083 (1992)

[Reference 12]
Japanese patent application laid-open No. 4-204980 (1992)

[Reference 13]
Japanese patent application laid-open No. 4-204981 (1992)

[Reference 14]
Japanese patent application laid-open No. 4-204982 (1992)

[Reference 15]
Japanese patent application laid-open No. 4-204983 (1992)

[Reference 16]
Japanese patent application laid-open No. 4-204984 (1992)

[Reference 17]
Japanese patent application laid-open No. 10-010922 (1998)

[Reference 18]
Japanese patent application laid-open No. 11-338304 (1999)

[Reference 19]
Japanese patent application laid-open No. 2004-13668

[Reference 20]
Japanese patent application laid-open No. 2004-157659

[Reference 21]
Japanese patent application laid-open No.2000-322137

Generally, the zero-crossing detecting circuit makes the full-wave rectification of the AC input power supply, detects that the absolute value of the power supply voltage falls below the threshold voltage including the zero-crossing point, and delivers the zero-crossing signal to the sequence controller. In this case, the zero-crossing signal becomes a pulse signal that inverts its voltage level according to whether the power supply voltage is less than the threshold voltage including the zero-crossing point or greater than the threshold voltage. In response to the pulse signal which is the zero-crossing signal, the sequence controller carries out the phase control. In this case, unless the voltage gradient in the threshold voltage neighborhood, that is, in the zero-crossing point neighborhood, in which the switching between the positive and negative is switched, has such a gradient as allowing the full-wave rectifier to make the rectification inversion, the zero-crossing cannot be detected. In other words, the zero-crossing detecting circuit cannot respond to a rectangular wave power supply with a sharp voltage gradient in the neighborhood of the zero-crossing point.

As a countermeasure against it, there is a method in which the zero-crossing detecting circuit makes a half-wave rectification of the AC input power supply, detects that the power supply voltage becomes greater or less than the threshold voltage including the zero-crossing point neighborhood, and delivers a pulse signal to the sequence controller. Since the zero-crossing detecting circuit detects the zero-crossing by the half-wave rectification, it can cope with the rectangular wave power supply with a sharp voltage gradient. In this case, the zero-crossing signal becomes a pulse signal that inverts its voltage level according to whether the power supply voltage is less than the threshold voltage including the zero-crossing point or greater than the threshold voltage. In other words, the zero-crossing signal becomes a pulse signal that inverts its voltage level in response to approximately the positive and negative of the AC input power supply. The sequence controller carries out the phase control in response to the pulse edges of the zero-crossing signal.

However, since the zero-crossing detecting circuit carries out the voltage detection by the half-wave rectification, a first direction edge of the zero-crossing signal such as a falling edge (rising edge) leads (or lags behind) a true zero-crossing point. In contrast with this, as for the edge in the direction opposite to the first direction, the rising edge (falling edge) lags behind (or leads) a true zero-crossing point. The time deviation from the true zero cross, which appears in the zero-crossing signal obtained by the half-wave rectification of the AC input power supply, brings about irregular phase deviation in the zero-crossing signal. More specifically, the irregular phase deviation is caused from the fact that the first half period of one period of the zero-crossing signal (from a falling edge to the next falling edge, for example) differs from the second half period (from the next falling edge to the next rising edge, for example). As a result, the temperature control in response to the zero-crossing signal can bring about ripples and unbalance that can cause the harmonic content of the current.

SUMMARY OF THE INVENTION

An object of the present invention is to provide a power supply apparatus capable of carrying out stable power control in response to a signal which is generated by correcting the deviation of the zero-crossing signal from the true zero cross of the AC input power supply, and which has the same amount of deviation for either the positive or negative polarity of the AC input power supply.

Another object of the present invention is to provide a power supply apparatus capable of carrying out stable power control in response to a signal which is generated by correcting the deviation of the zero-crossing signal from the true zero cross of the AC input power supply, and which has a rising/falling edge previous to and having the same amount of deviation from the true zero-crossing point for either the positive or negative polarity of the AC input power supply.

Still another object of the present invention is to provide a power supply apparatus capable of carrying out stable power control in response to an appropriately corrected signal which is obtained by eliminating the effect of frequency fluctuations of the AC input power supply.

Still another object of the present invention is to provide a power supply apparatus capable of carrying out stable power control in response to an appropriately corrected signal which is obtained by eliminating the effect of frequency fluctuations of the AC input power supply, even if the frequency of the AC input power supply fluctuates, and particularly fluctuates greatly in the higher direction.

Still another object of the present invention is to provide a power supply apparatus capable of carrying out stable power control in response to a signal which is corrected appropriately by eliminating the effect of the misdetection even if the zero cross of the power supply out of the frequency range is misdetected.

Still another object of the present invention is to provide a power supply apparatus capable of carrying out safe power control, which can halt the power supply if the zero cross of the power supply, the frequency of which is such far out of the range that disables the power control, is detected.

Still another object of the present invention is to provide a power supply apparatus capable of carrying out stable power control in response to a signal which is corrected appropriately by suppressing the variations of the zero-crossing detecting circuit and the effect of misdetection-even if the frequency of the AC input power supply fluctuates.

Still another object of the present invention is to provide a power supply apparatus capable of carrying out stable power control for the controlled system with lesser ripples in response to the appropriately corrected signal.

Still another object of the present invention is to provide a heating apparatus capable of stable temperature control by carrying out stable power control in response to an appropriately corrected signal.

Still another object of the present invention is to provide an image forming apparatus having a fuser capable of stable temperature control in response to an appropriately corrected signal even if the power supply frequency fluctuates.

According to a first aspect of the present invention, that is provided a power supply apparatus comprising: a voltage detecting section for outputting a first pulse signal which is at a first voltage level when the AC power supply voltage is below a specified threshold value, and at a second voltage level when the AC power supply voltage exceeds the specified threshold value; anda power control section for controlling supplied power in response to the first pulse signal fed from said voltage detecting section, wherein said power control section successively measures a period of an edge in one direction of the first pulse signal fed from said voltage detecting section, sets a set time period at a time period equal to half the period of the edge in one direction, and controls a switching device for switching between turning-on and turning-off of said AC power supply in accordance with timing of the edge in one deirection and timing when the set time period has elapsed after the edge in one direction.

Here, if a time period equal to half the measured period is out of a range of a preset time period, said power control section may not update the set time period.

If the edge in the other direction is detected before the set time period has elapsed after the edge in one direction, said power control section may update the set time period to a time period from the edge in one direction to the edge in the other direction.

The power control section may halt the power supply if a time period equal to half the measured period is out of the range of the preset time period continuously for more than a specified time period.

If a time period difference between the set time period and a time period equal to half newly measured period is within the preset time period, said power control section may not update the set time period.

If the edge in the other direction is detected before the set time period has elapsed after the edge-in one direction, said power control section may update the set time period to a time period from the edge in one direction to the edge in the other direction.

If a time period difference between the set time period and a time period equal to half newly measured period is within the preset time period, said power control section may not update the set time period.

The power control section may carry out phase control of the supplied power.

The voltage detecting section may output the first pulse signal in accordance with a lower-potential-side output potential of a voltage of a rectification circuit for carrying out full-wave rectification of said AC power supply and one line voltage of said AC power supply.

The voltage detecting section may output the first pulse signal in accordance with two line voltages of said AC power supply.

According to a second aspect of the present invention, that is an image forming apparatus including an image forming section for forming a toner image on a recording medium, and a fuser for fusing the toner image on the recording medium by heating the toner image, wherein said fuser comprises: heating means including a heating element; temperature detecting section for detecting temperature of said heating means; and the power supply apparatus which supplies power to the heating element of said heating means for heating, and wherein said power supply apparatus comprises: a voltage detecting section for outputting a first pulse signal which is at a first voltage level when the AC power supply voltage is below a specified threshold value, and at a second voltage level when the AC power supply voltage exceeds the specified threshold value; and a power control section for controlling supplied power in response to the first pulse signal fed from said voltage detecting section, wherein said power control section successively measures a period of an edge in one direction of the first pulse signal fed from said voltage detecting section, sets a set time period at a time period equal to half the period of the edge in one direction, and controls a switching device for switching between turning-on and turning-off of said AC power supply in accordance with timing of the edge in one deirection and timing when the set time period has elapsed after the edge in one direction.

According to the present invention, the power supply apparatus can carry out stable power control in response to a signal which is generated by correcting the deviation of the zero-crossing signal from the true zero cross of the AC input power supply, and which has the same amount of deviation for either the positive or negative polarity of the AC input power supply.

According to the present invention, the power supply apparatus can carry out stable power control in response to a signal which is generated by correcting the deviation of the zero-crossing signal from the true zero cross of the AC input power supply, and which has a rising/falling edge previous to and having the same amount of deviation from the true zero-crossing point for either the positive or negative polarity of the AC input power supply.

According to the present invention, the power supply apparatus can carry out stable power control in response to an appropriately corrected signal which is obtained by eliminating the effect of frequency fluctuations of the AC input power supply.

According to the present invention, the power supply apparatus can carry out stable power control in response to an appropriately corrected signal which is obtained by eliminating the effect of frequency fluctuations of the AC input power supply, even if the frequency of the AC input power supply fluctuates, and particularly fluctuates greatly in the higher direction.

According to the present invention, the power supply apparatus can carry out stable power control in response to a signal which is corrected appropriately by eliminating the effect of the misdetection even if the zero cross of the power supply out of the frequency range is misdetected.

According to the present invention, the power supply apparatus can carry out safe power control, which can halt the power supply if the zero cross of the power supply, the frequency of which is such far out of the range that disables the power control, is detected.

According to the present invention, the power supply apparatus can carry out stable power control in response to a signal which is corrected appropriately by suppressing the variations of the zero-crossing detecting circuit and the effect of the misdetection even if the frequency of the AC input power supply fluctuates.

According to the present invention, the power supply apparatus can carry out stable power control for the controlled system with lesser ripples in response to the appropriately corrected signal.

According to the present invention, the heating apparatus is provided which can achieve stable temperature control by carrying out stable power control in response to an appropriately corrected signal.

According to the present invention, the image forming apparatus is provided which has a fuser capable of stable temperature control in response to an appropriately corrected signal even if the power supply frequency fluctuates.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The invention will now be described with reference to the accompanying drawings.

Embodiment 1

Figure 1:
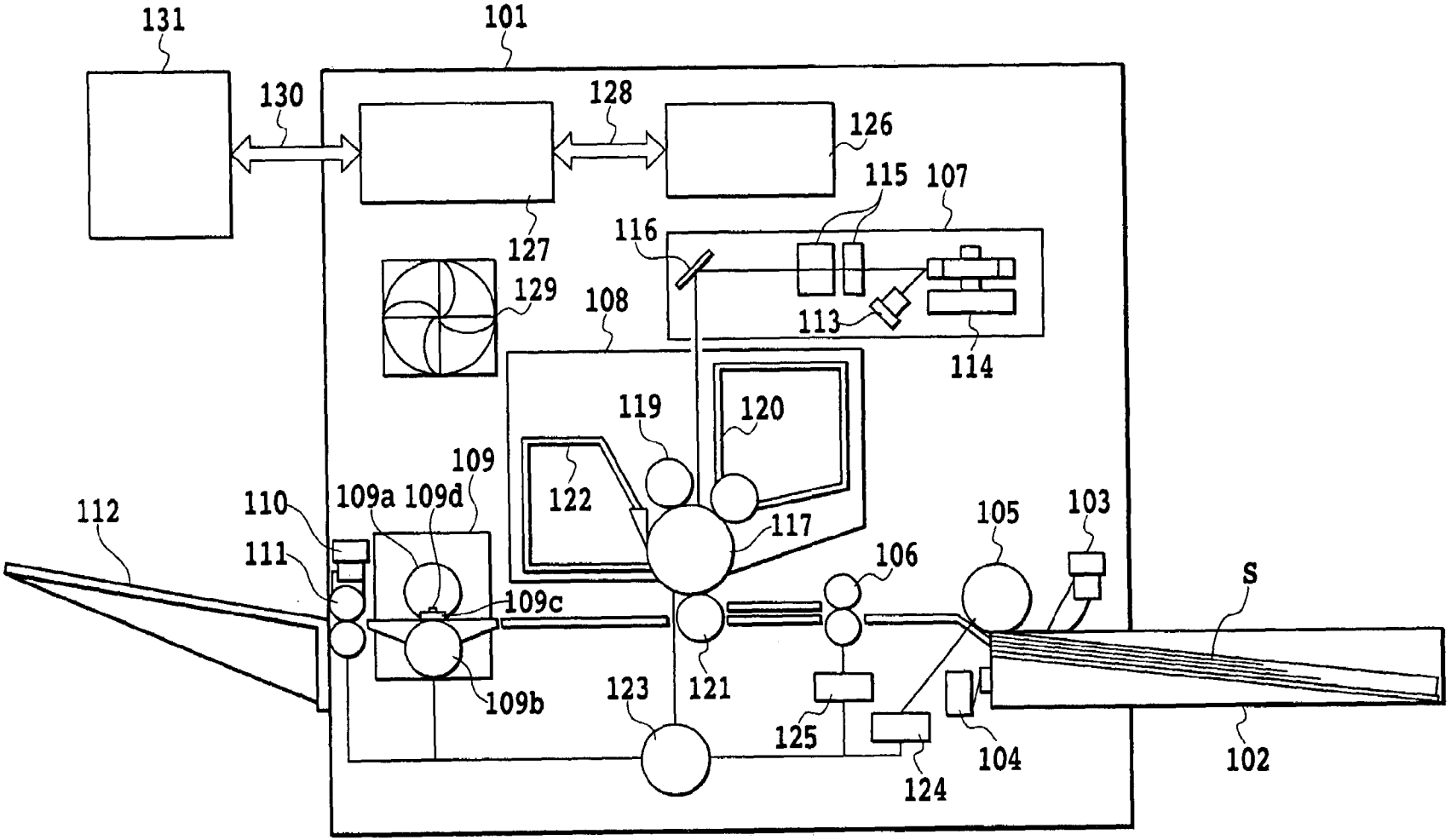
FIG. 1 is a diagram illustrating an image forming apparatus in accordance with the present invention.

FIG. 1 is a diagram showing a schematic configuration of an image forming apparatus using electrophotographic process in accordance with the present invention. The image forming apparatus is a laser beam printer. The present invention is applicable to other image forming apparatuses such as copying machines and facsimiles. A main unit 101 of the laser beam printer includes a cassette 102 for holding recording paper S, and a cassette paper sensor 103 for detecting the presence and absence of the recording paper S in the cassette 102. The main unit 101 of the laser beam printer further includes a cassette size sensor 104 (composed of a plurality of microswitches) for deciding the size of the recording paper S in the cassette 102. The main unit 101 of the laser beam printer further includes a paper feed roller 105 for sending out the recording paper S from the cassette 102.

Downstream from the paper feed roller 105, a pair registration rollers 106 is provided for transporting the recording papers in synchronization. Downstream from the pair registration rollers 106, an image forming section 108 is provided for generating a toner image on the recording paper S in response to the laser beam from a laser scanner section 107. Downstream from the image forming section 108, a fuser 109 is provided for heat fusing the toner image formed on the recording paper S.

Downstream from the fuser 109, there are provided a paper output sensor 110 for detecting a transport state of the paper output section, a paper output roller 111 for ejecting the recording paper S, and a paper output tray 112 for stacking the recording paper S passing through the recording. A transport reference of the recording paper S is set in such a manner as to be placed at the center of the width of the recording paper S, that is, of the length in the direction perpendicular to the transport direction of the recording paper S of the image forming apparatus.

The laser scanner 107 includes a laser unit 113 for emitting a laser beam modulated in response to an image signal (image signal VDO) sent from an external apparatus 131 which will be described later. The laser scanner 107 further includes a polygon motor 114, an imaging lens 115, and a reflecting mirror 116 for causing the laser beam from the laser unit 113 to scan a photoconductive drum 117.

The image forming section 108 includes components necessary for the known electrophotographic process: the photoconductive drum 117, a primary charging roller 119, a developing unit 120, a transfer charging roller 121, and a cleaner 122. The fuser 109 includes a fusing film 109*a*, an elastic press roller 109*b*, a ceramic face heater 109*c* installed in the fusing film, and a thermistor 109*d* for detecting the surface temperature of the ceramic face heater 109*c*.

A main motor 123 supplies driving force to the paper feed roller 105 via a paper feed roller clutch 124, and to the pair of registration rollers 106 via a registration roller clutch 125. The main motor 123 further supplies driving force to respective units of the image forming section 108 including the photoconductive drum 117, to the fuser 109, and to the paper output roller 111.

The engine controller 126 includes a CPU that executes various types of control which will be described later, a RAM that provides a work area of the CPU, and a ROM that stores control programs of the CPU. The engine controller 126 carries out under the control of the CPU the control of the electrophotographic process by the laser scanner section 107, image forming section 108 and fuser 109, which includes the power control characterizing the present invention which will be described later; and the transport control of the recording paper in the main unit 101 of the laser beam printer. Incidentally, as for the setting of the time period A which will be described later, a user can set it by directly inputting its value from a control panel mounted on an upper portion of the main unit 101 of the laser beam printer. Alternatively, the time period A can be set through the external apparatus 131 such as a personal computer.

A video controller 127 is connected to the external apparatus 131 such as a personal computer via a general-purpose interface (such as Centronics and RS232C) 130. The video controller 127 develops the image information sent from the general-purpose interface into bit data, and delivers the bit data to the engine controller 126 as a VDO signal.

Figure 2:
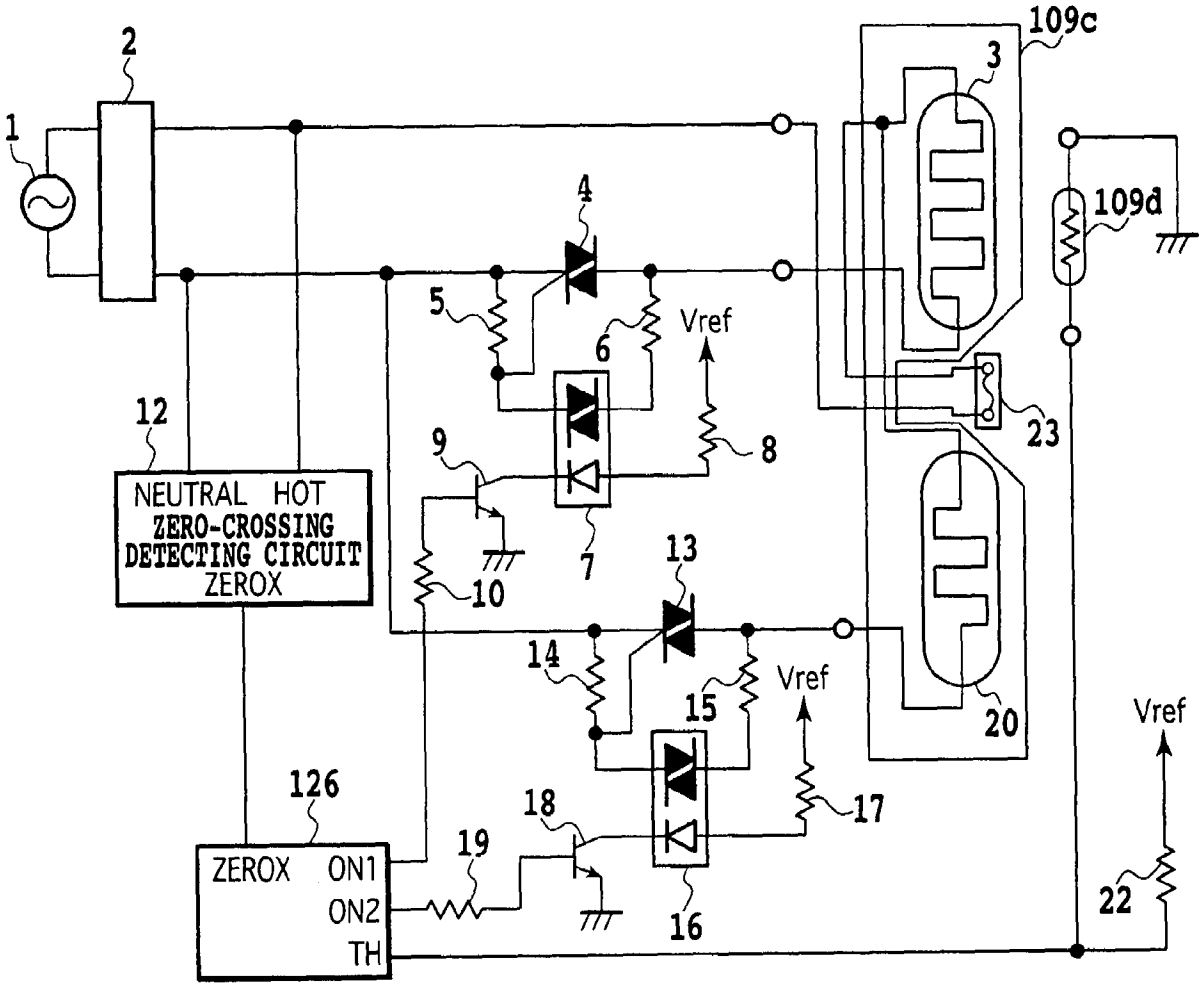
FIG. 2 is a diagram showing a control and driving circuit of a fuser of a first embodiment in accordance with the present invention.

FIG. 2 shows the driving and control circuit of the ceramic heater in accordance with the present invention. In FIG. 2, the reference numeral 1 designates an AC power supply of the laser beam printer. The AC power supply 1 is connected to a heating element 3 and a heating element 20 constituting the ceramic face heater 109*c* via an AC filter 2. The power supply to the heating element 3 is carried out by turning on and off a triac 4. Likewise, the power supply to the heating element 20 is carried out by turning on and off a triac 13.

Figure 7:
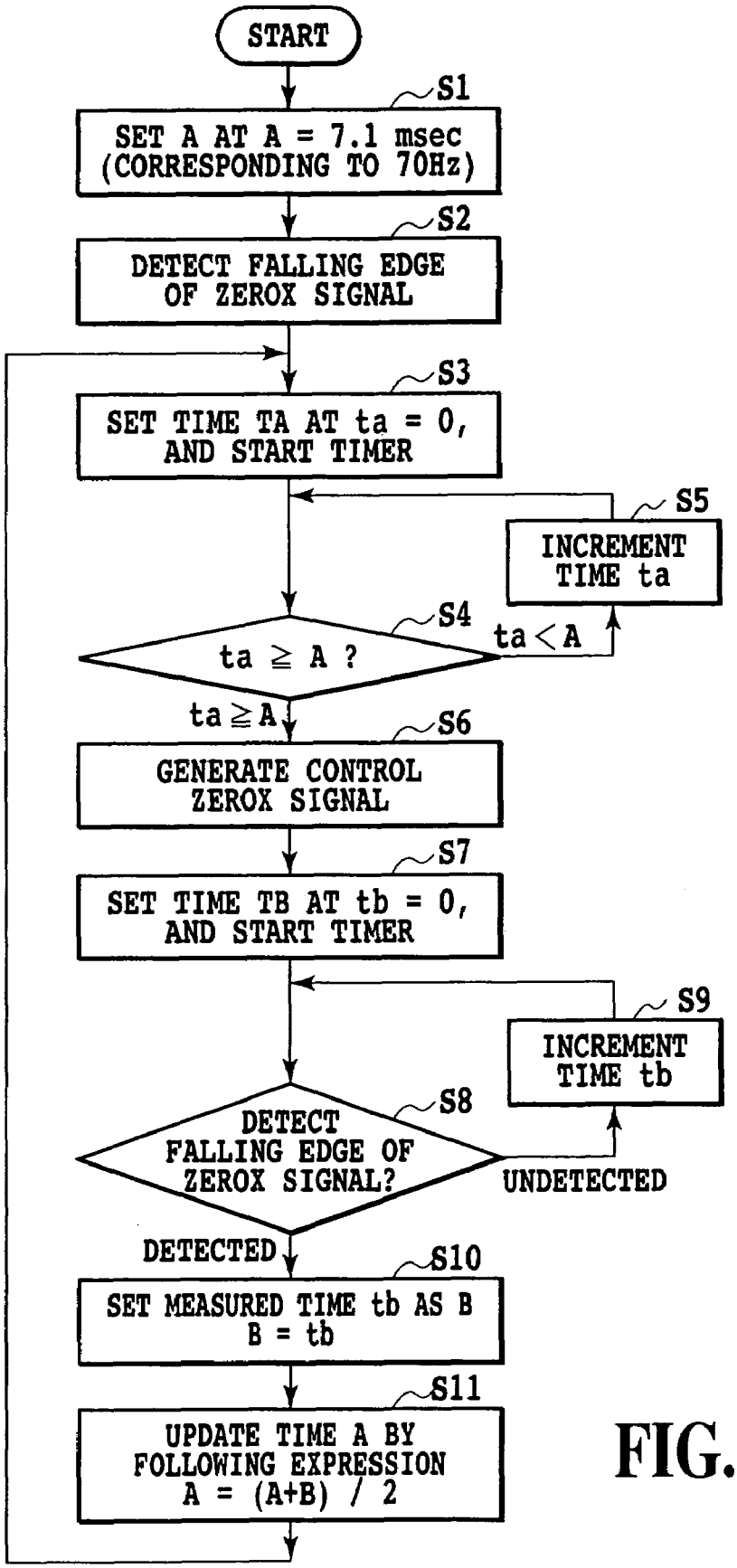
FIG. 7 is a flowchart illustrating a control sequence in the first embodiment in accordance with the present invention.

Reference numerals 5 and 6 designate bias resistors for the triac 4, and the reference numeral 7 designates a phototriac coupler for establishing the creeping distance between the primary and secondary. The triac 4 is turned on by passing a current through the light emitting diode of the phototriac coupler 7. The reference numeral 8 designates a resistor for limiting the current of the phototriac coupler 7. The reference numeral 9 designates a transistor for carrying out the ON/OFF control of the phototriac coupler 7. The engine controller 126 has an input circuit of the ZEROX signal, an input circuit of a TH signal, and an output circuit of an ON1 signal and ON2 signal, which will be described later. The engine controller 126 has its internal CPU execute the control procedure as illustrated in FIG. 7, which is stored in an internal ROM and will be described later. At that time, the engine controller 126, referring to the signals from the input circuit of the ZEROX signal and the input circuit of the TH signal, outputs a specified signal from the output circuit of the ON1 signal and ON2 signal.

The transistor 9 operates in response to the ON1 signal fed from the engine controller 126 via the resistor 10. Reference numerals 14 and 15 designate bias resistors for the triac 13. The reference numeral 16 designates a phototriac coupler for establishing the creeping distance between the primary and secondary. The triac 13 is turned on by passing a current through the light emitting diode of the phototriac coupler 13. The reference numeral 17 designates a resistor for limiting the current of the phototriac coupler 16. The reference numeral 18 designates a transistor for carrying out the ON/OFF control of the phototriac coupler 16. The transistor 18 operates in response to the ON2 signal fed from the engine controller 126 via the resistor 19.

The reference numeral 12 designates a zero-crossing detecting circuit connected to the AC power supply 1 via the AC filter 2. The zero-crossing detecting circuit 12 informs the engine controller 126 that the voltage of the AC power supply 1 is below the threshold voltage via a pulse signal (called "ZEROX signal" from now on). The engine controller 126 detects the edge of the pulse of the ZEROX signal, and carries out the ON/OFF control of the triac 4 or 13 by the phase control or wave number control.

The reference numeral 109*d* designates a thermistor for detecting the temperature of the ceramic face heater 109*c* composed of the heating elements 3 and 20. The thermistor 109*d* is mounted on the ceramic face heater 109*c* via an insulator with sufficient dielectric strength so that it can establish the insulating distance from the heating elements 3 and 20. The thermistor 109*d* detects the temperature as a voltage divided by a resistor 22 and the thermistor 109*d*, and supplies the voltage to the engine controller 126 as a digital TH signal after passing through A/D conversion. The engine controller 126 monitors the temperature of the ceramic face heater 109*c* in terms of the TH signal. The engine controller 126 compares the temperature of the ceramic face heater 109*c* with a preset temperature of the ceramic face heater 109*c*, which is set in the engine controller. Thus, the engine controller 126 calculates the power ratio to be supplied to the heating elements 3 and 20 constituting the ceramic face heater 109*c*, and converts the power ratio to a phase angle (phase control) or wave number (wave number control). According to the control conditions, the engine controller 126 delivers the ON1 signal to the transistor 9 or the ON2 signal to the transistor 18. In the case of the phase control, for example, the engine controller 126 has a control table such as the following Table 1 in the ROM or RAM in the engine controller 126, and the CPU in the engine controller 126 carries out the control according to the control table.

TABLE 1

| power ratio duty D(%) | phase angle Y (°) |
|---|---|
| 100 | 0 |
| 97.5 | 28.56 |
| . | . |
| . | . |
| . | . |
| 75 | 66.17 |
| . | . |
| . | . |
| . | . |
| 50 | 90 |
| . | . |
| . | . |
| . | . |
| 25 | 113.83 |
| . | . |
| . | . |
| . | . |
| 2.5 | 151.44 |
| 0 | 180 |

Furthermore, a thermostat 23 is mounted on the ceramic face heater 109*c* for protecting overheating in the event of thermal runaway of the heating elements 3 and 20 because of a failure of a means for supplying power to the heating elements 3 and 20 and for controlling it. If the heating elements 3 and 20 exhibit thermal runaway and the thermostat 23 exceeds the specified temperature because of the failure of the power supply control means, the thermostat 23 is opened to interrupt the current to the heating elements 3 and 20.

Figure 3A:
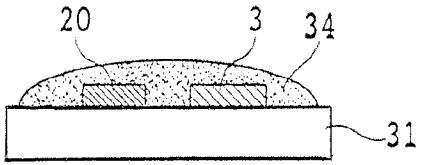
FIGS. 3A-3C are diagrams showing a sketch of a ceramic heater which is a heating means in accordance with the present invention.
Figure 3B:
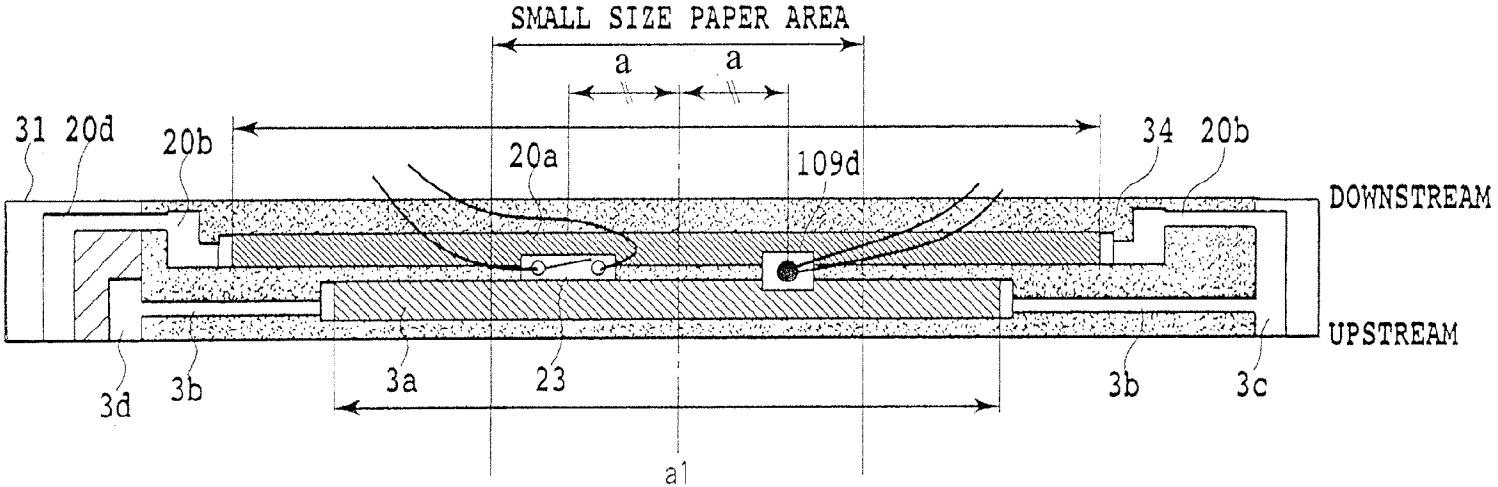
Figure 3C:
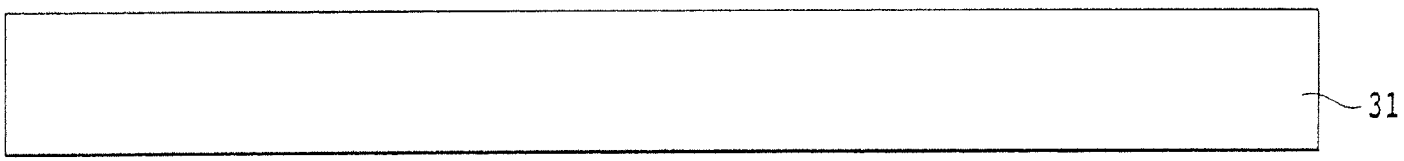

FIGS. 3A-3C show a structure of the ceramic face heater 109*c* of FIG. 1: FIG. 3A shows a transverse section of the ceramic face heater 109*c*; FIG. 3B shows a surface in which the heating elements 3 and 20 are formed; and FIG. 3C shows a surface opposite to that of FIG. 3B.

The ceramic face heater 109*c* includes an insulating substrate 31 composed of a ceramic based material such as SiC, AlN and $Al_2O_3$; the heating elements 3 and 20 formed on the surface of the insulating substrate 31 by paste printing or the like; and a protective layer 34 composed of glass and the like to protect the two heating elements. On the protective layer 34, the thermistor 109*d* and the thermostat 23 are mounted in such a manner that they have left-right symmetry (denoted as "a" in FIG. 3B) with respect to the transport reference al of the recording paper (the center line in the longitudinal direction of the heating sections 3*a* and 20*a*), and that they are placed inside the width of the minimum recording paper that can pass through there.

The heating element 3 includes a heating section 3*a* that heats when the power is supplied; electrodes 3*c* and 3*d* to which the power is supplied via a connector; and conductors 3*b* for connecting the electrodes 3*c* and 3*d* to the heating section 3*a*. Likewise, the heating element 20 includes a heating section 20*a* that heats when the power is supplied; electrodes 3*c* and 20*d* to which the power is supplied via the connector; and conductors 20*b* for connecting the electrodes 3*c* and 20*d* to the heating section 20*a*. The electrode 3*c* is connected to the two heating elements 3 and 20 to become a common electrode of the heating elements 3 and 20. Incidentally, a glass layer can also be formed on the surface of the insulating substrate 31 opposite to the surface on which the heating elements 3 and 20 are formed to increase the slidableness.

To the common electrode 3*c*, the HOT side terminal of the AC power supply 1 is connected via the thermostat 23. The electrode 3*d* is connected to the triac 4 for controlling the heating element 3, and then to the Neutral terminal of the AC power supply 1. The electrode 20*d* is electrically connected to the triac 13 for controlling the heating element 20, and then to the Neutral terminal of the AC power supply 1.

Figure 4B:
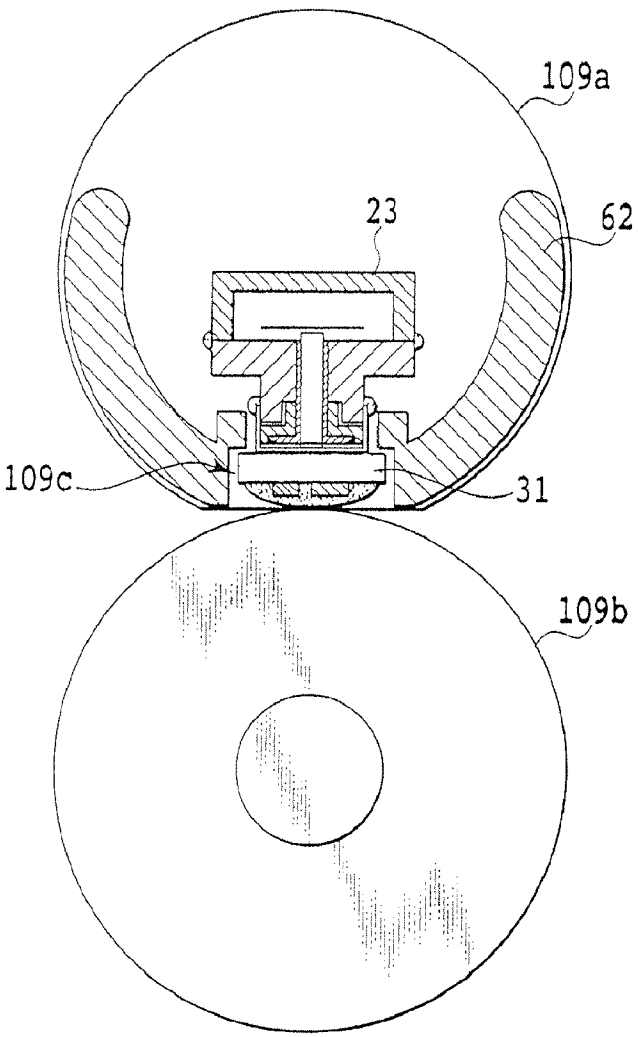
FIGS. 4A and 4B are diagrams showing a schematic configuration of a fuser in accordance with the present invention.
Figure 4A:
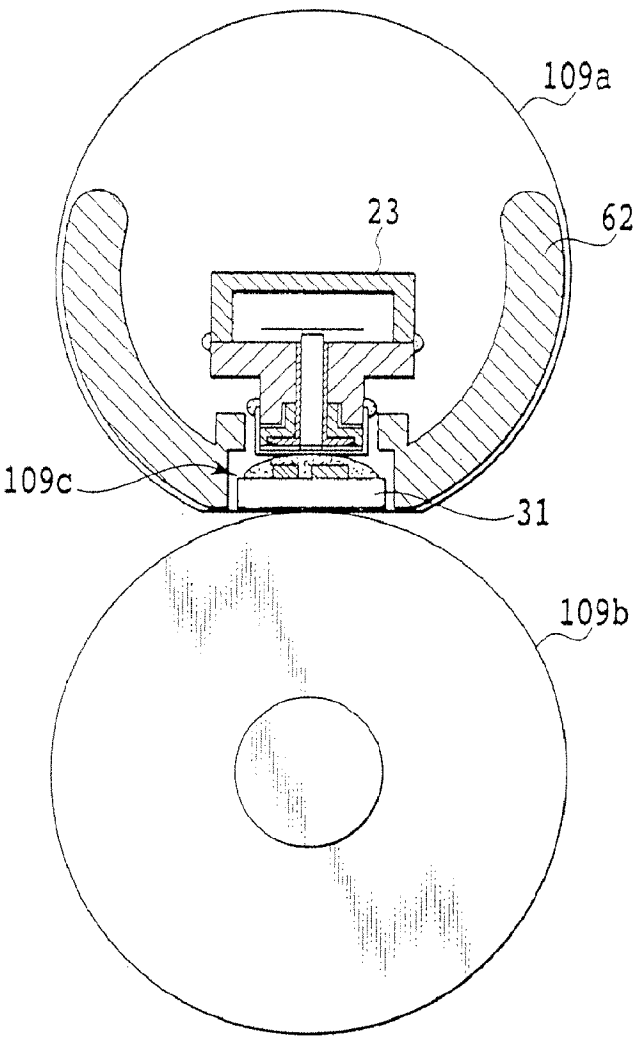

The ceramic face heater 109*c* is supported by a film guide 62 as shown in FIG. 4. The reference numeral 109*a* designates a fusing film composed of a cylindrical high-temperature material. The fusing film is placed over the film guide 62, at the bottom surface of which the ceramic face heater 109*c* is supported. The ceramic face heater 109*c* and the elastic press roller 109*b*, between which the fusing film 109*a* is sandwiched, are pressed against each other via the elasticity of the elastic press roller 109*b* at a specified pressure, thereby forming a fusing nip portion serving as a heating section and having a predetermined width. The thermostat 23 is placed on the surface of the insulating protective layer 34 (FIG. 4A) or on the surface of the substrate 31 (FIG. 4B) of the ceramic face heater 109*c*. The thermostat 23 undergoes positional correction by the film guide 62 so that the thermosensitive surface of the thermostat 23 is placed on the ceramic face heater 109*c*. Although not shown in the drawings, the thermistor 109*d* is also placed on the surface of the ceramic face heater 109*c*. As for the ceramic face heater 109*c*, it does not matter whether the heating elements 3 and 20 are placed on the opposite side to the nip portion or on the same side as the nip portion as shown in FIGS. 4A and 4B. To increase the slidableness of the fusing film 109*a*, lubricant grease may be applied to the interface between the fusing film 109*a* and the ceramic face heater 109*c*.

Figure 5:
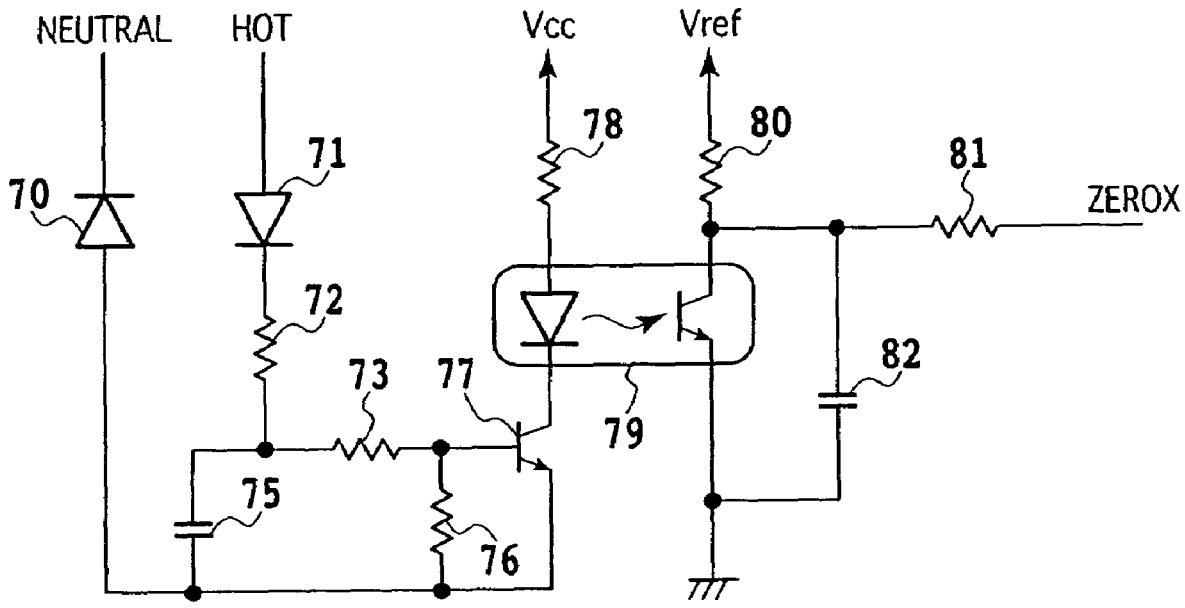
FIG. 5 is a diagram illustrating a zero-crossing detecting circuit of the first embodiment in accordance with the present invention.
Figure 6:
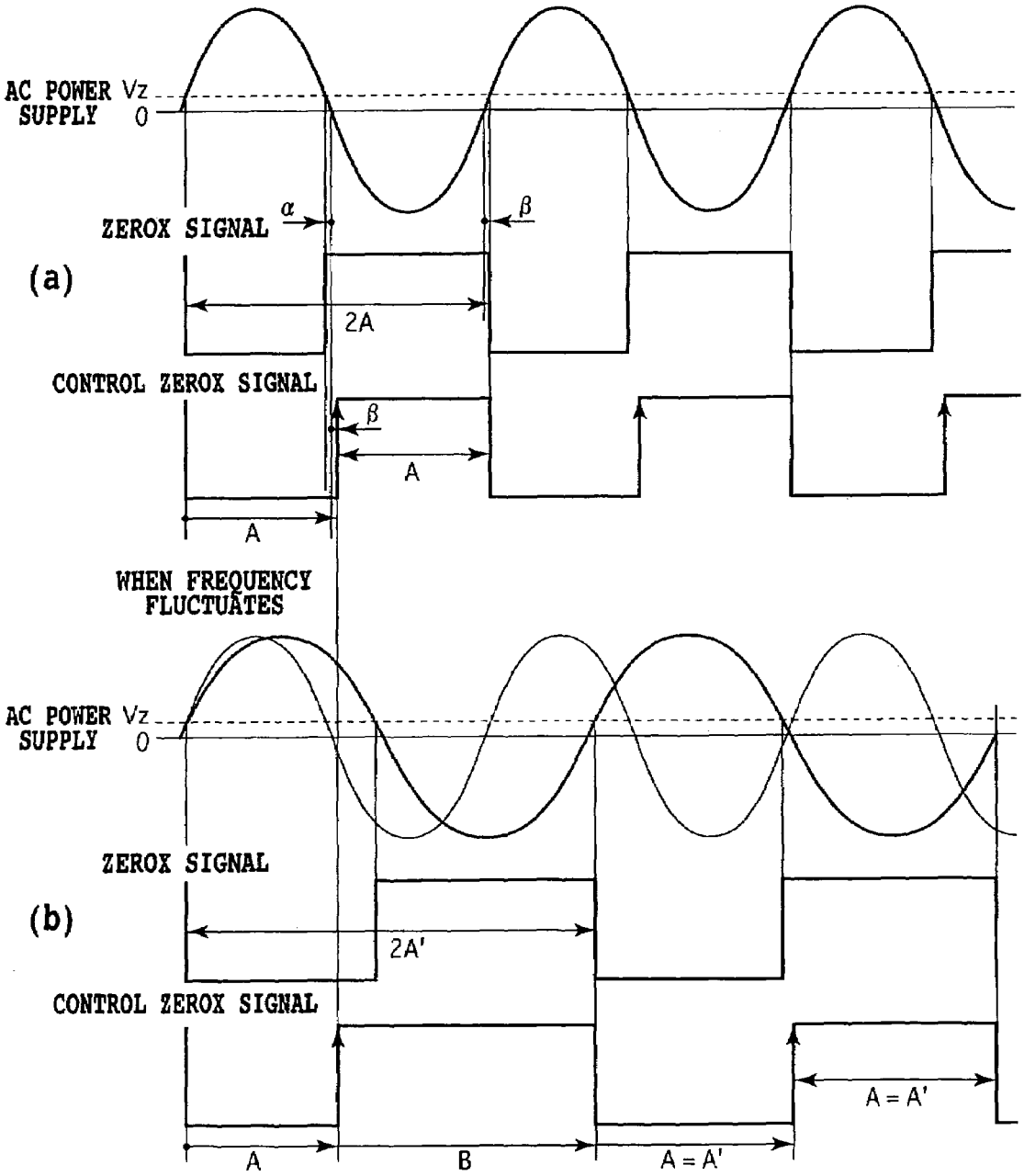
FIG. 6 is a diagram illustrating an outline of a ZEROX signal and control operation of an engine controller in accordance with the present invention.

FIG. 5 shows the zero-crossing detecting circuit 12 in accordance with the present invention; and FIG. 6 illustrates an outline of the ZEROX signal and the control operation in the engine controller 126.

The AC power supply 1 undergoes half-wave rectification by rectifier diodes 70 and 71. The diode 70 can be short-circuited as the case maybe. The Hot side potential is supplied to a transistor 77 via the rectifier diode 71 and current limiting resistors 72 and 73. A resistor 76 is a base-emitter resistor of the transistor 77. The reference numeral 75 designates a capacitor for eliminating noise from the AC power supply 1. The resistor 73 can be short-circuited.

The reference numeral 79 designates a photocoupler for establishing a creeping distance between primary and secondary. The primary side power supply Vcc is connected to the light-emitting side of the photocoupler 79 and the transistor 77 via the current limiting resistor 78. The reference numeral 80 designates a current limiting resistor of the output transistor of the photocoupler 79. The output of the photocoupler 79 is supplied to the engine controller 126 via a capacitor 82 and a resistor 81 as the ZEROX signal.

When the Hot side potential is higher than the Neutral potential, and greater than the threshold voltage Vz determined by the diodes 70 and 71, resistors 72, 73 and 76, capacitor 75, and transistor 77, the transistor 77 and photocoupler 79 are brought into conduction, and the ZEROX signal is placed at a low level. In contrast, when the Hot side potential is lower than the Neutral potential, or when the Hot side potential is smaller than the threshold voltage Vz, the transistor 77 and photocoupler 79 are brought out of conduction, and the ZEROX signal becomes a high level. In other words, the ZEROX signal is a pulse signal that changes its level according to whether the Hot side potential is higher or lower than the Neutral side potential by an amount equal to the threshold voltage Vz. However, the rising edge of the ZEROX signal that occurs when the Hot side potential falls below the threshold voltage Vz shifts previously to the true zero-crossing point by a time period $\alpha$. In addition, the falling edge of the ZEROX signal that occurs when the Hot side potential exceeds the threshold voltage Vz lags behind the true zero-crossing point by a time period $\beta$. Using the ZEROX signal without change as the trigger signal of the phase control, the time period ($\alpha+\beta$) becomes the phase deviation for either the positive or negative polarity of the input power supply.

In the present embodiment, the engine controller 126 measures the one period (2A) of the falling signal of the ZEROX signal, and calculates half the time period A. Then, the engine controller 126 generates pseudo-rising edges after the time period A from the falling edges of the ZEROX signal in later periods, and generates a control ZEROX signal from the falling edges of the ZEROX signal and the pseudo-rising edges. The one period (2A) of the falling signal of the ZEROX signal can be measured periodically at appropriate time intervals. The engine controller 126 carries out the phase control using the control ZEROX signal as the trigger signal. More specifically, the engine controller 126 employs the time period A as the basic time period in the phase control, and compares the time period A with a phase angle $\gamma$ calculated from a determined power ratio D. Thus, the engine controller 126 determines the time to send out the ON1 or ON2 signal, and carries out the phase control by sending out the ON1 or ON2 signal after that time has elapsed from the edges of the control ZEROX signal.

As for the control ZEROX signal, both the rising edge and falling edge deviate from the true zero-crossing point by the time period β, and hence it has no phase deviation between the positive and negative polarities of the input power supply. As a result, it can achieve stable phase control.

In addition, it can cope with the fluctuations of the power supply frequency during the control as follows. Specifically, the engine controller 126 calculates the time period B from the rising edge of the control ZEROX signal, which occurs after the preset time period A from the falling edge of the ZEROX signal, to the next falling edge of the ZEROX signal. Then, the engine controller 126 sets the time A' equal to half the sum of the time period A and time period B, (A+B)/2, as the updated time period A. Using the updated time period A, the engine controller 126 generates the falling/rising edges of the control ZEROX signal, thereby enabling tracking in spite of the fluctuations of the power supply frequency. In this case, (A+B) is a time period corresponding to one period of the power supply frequency, and is determined only by the interval between the falling edges of the ZEROX signal.

FIG. 7 is a flowchart illustrating the control sequence of the present embodiment.

The initial value of the time period A is set at a value within a conceivable range of the power supply frequency, at a time period corresponding to the upper limit of 70 Hz, for example (S1). It is set at the upper limit because more stable tracking is possible when the power supply frequency fluctuates in a lower direction. Thus, as half the period, the time period A is set at 7.1 msec. The engine controller 126 detects the falling edge of the ZEROX signal fed from the zero-crossing detecting circuit 12 (S2), places the time period ta=0, and starts a timer for measuring the time period A (S3). Until the time period ta becomes the time period A (S4), the timer increments the time period ta (S5). Once the time period ta has reached the time period A (S4), the engine controller 126 generates the pseudo-rising edge, and generates the control ZEROX signal (S6). Subsequently, the engine controller 126 sets the time period tb=0, and starts a timer for measuring the time period B (S7). Until it detects the falling edge of the ZEROX signal fed from the zero-crossing detecting circuit 12 (S8), the timer increments the time period tb (S9). When the engine controller 126 detects the falling edge of the ZEROX signal (S8), it sets the time period tb as the time period B (S10). Then, it sets half the sum of the time period A and time period B, (A+B)/2, as the updated time period A (S11). The engine controller returns to step S3 to repeat the sequence.

As described above, according to the present embodiment, the engine controller generates, from the ZEROX signal fed from the zero-crossing detecting circuit, the symmetrical control ZEROX signal which has equal phase deviation from the true zero-crossing point for either positive or negative polarity of the AC input power supply. The phase control based on the control ZEROX signal enables the stable power control for the polarities of the input power supply, that is, enables the stable temperature control. Since the zero-crossing detecting circuit detects the zero cross using the half-wave rectification, it is applicable to a power supply having a waveform with a sharp power supply voltage gradient near the zero-crossing points such as a rectangular wave power supply output from an uninterruptible regulated power supply.

In addition, the engine controller sets the time period from the falling edge of the ZEROX signal to the time at which it generates the rising edge of the control ZEROX signal at A. The engine controller sets the time period from the rising edge of the control ZEROX signal to the time at which it detects the falling edge of the ZEROX signal at B. Using the time periods A and B, the engine controller makes the time period (A+B)/2 the updated time period A, and generates the control ZEROX signal. This enables the tracking in spite of the frequency fluctuations, and the power control, that is, the temperature control free from the effect of the power supply frequency fluctuations.

Similar control can be achieved even if only one heating element is used, or when the direction of the edge detection of the ZEROX signal is in the opposite direction.

Embodiment 2

Figure 8:
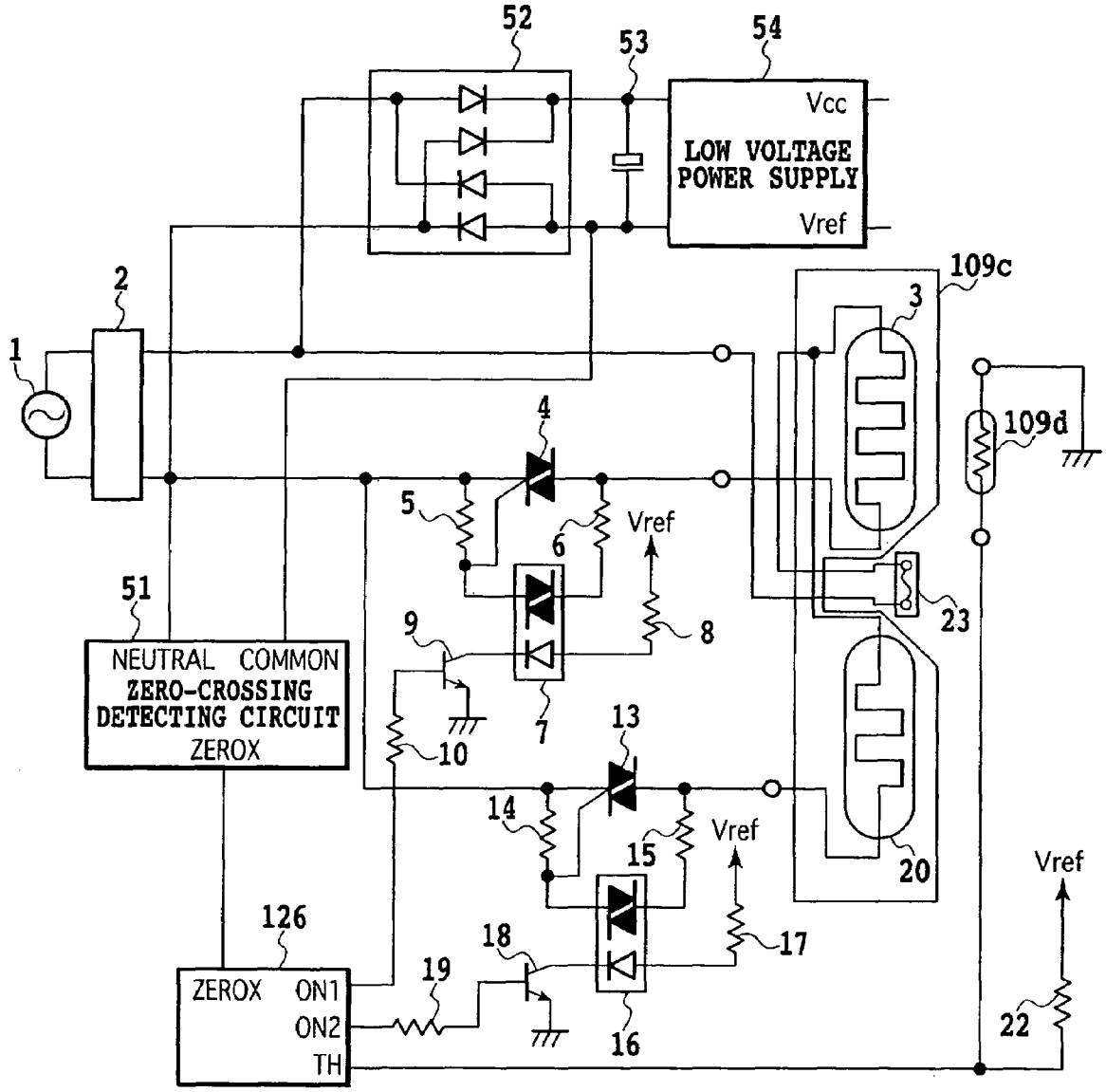
FIG. 8 is a diagram showing a control and driving circuit of a fuser of a second embodiment in accordance with the present invention.

FIG. 8 shows a driving and control circuit of the ceramic heater in accordance with the present invention. In FIG. 8, the same components as those of FIG. 2 are designated by the same reference numerals, and the duplicate description of the first embodiment may be omitted below.

The reference numeral 52 designates a diode bridge rectifier connected to the AC power supply 1 via the AC filter 2 for carrying out full-wave rectification of the AC power supply 1. The AC power supply 1 subjected to the full-wave rectification is smoothed by a smoothing capacitor 53, and is supplied to a low voltage power supply 54 for generating a secondary power supply used for controlling the image forming section. Generally, the low voltage power supply comprises an insulating transformer which isolates its secondary side from the primary side, and reduces the voltage to a desired power supply voltage by a turns ratio; and a regulation means such as a switching control means and a series dropper. Here, an output voltage Vref is a secondary control voltage output from the low voltage power supply, and an output voltage Vcc is a primary side power supply voltage generated by an auxiliary winding and the like of the low voltage power supply.

The reference numeral 51 designates a zero-crossing detecting circuit of the AC power supply 1, which is connected to a first potential of the AC power supply, a Neutral side potential here, and to a low potential side potential (called "Common potential" from now on) after the full-wave rectification by the diode bridge rectifier 52. The zero-crossing detecting circuit 51 informs the engine controller 126 that the voltage of the AC power supply 1 falls below the threshold voltage by means of a pulse signal (called "ZEROX signal" from now on). The engine controller 126 detects the edges of the pulses of the ZEROX signal, and carries out the ON/OFF control of the triac 4 or 13 by the phase control or wave number control.

Figure 9:
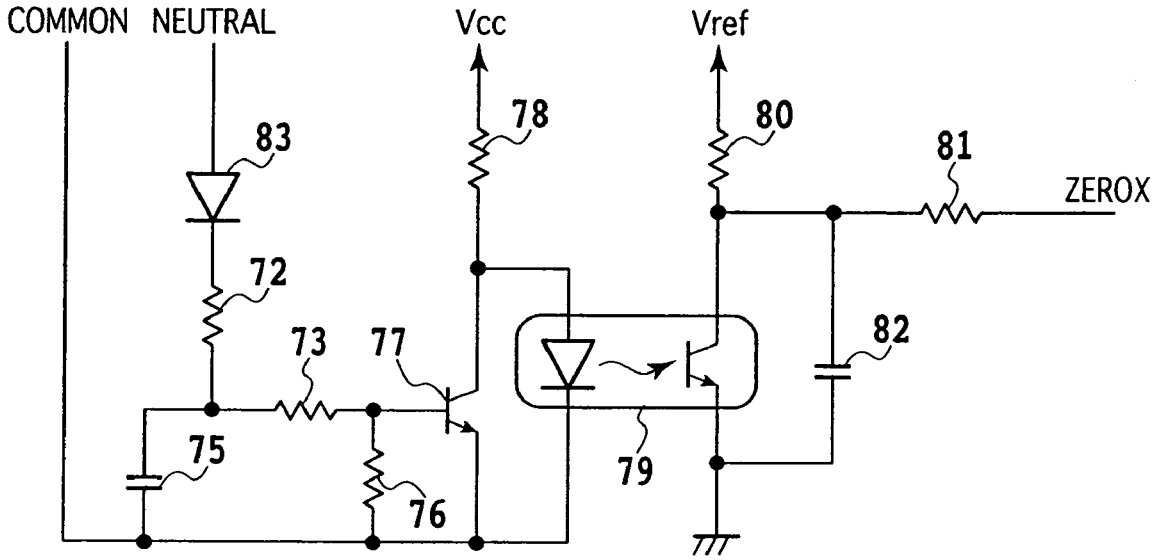
FIG. 9 is a diagram illustrating a zero-crossing detecting circuit of a second embodiment in accordance with the present invention.
Figure 10:
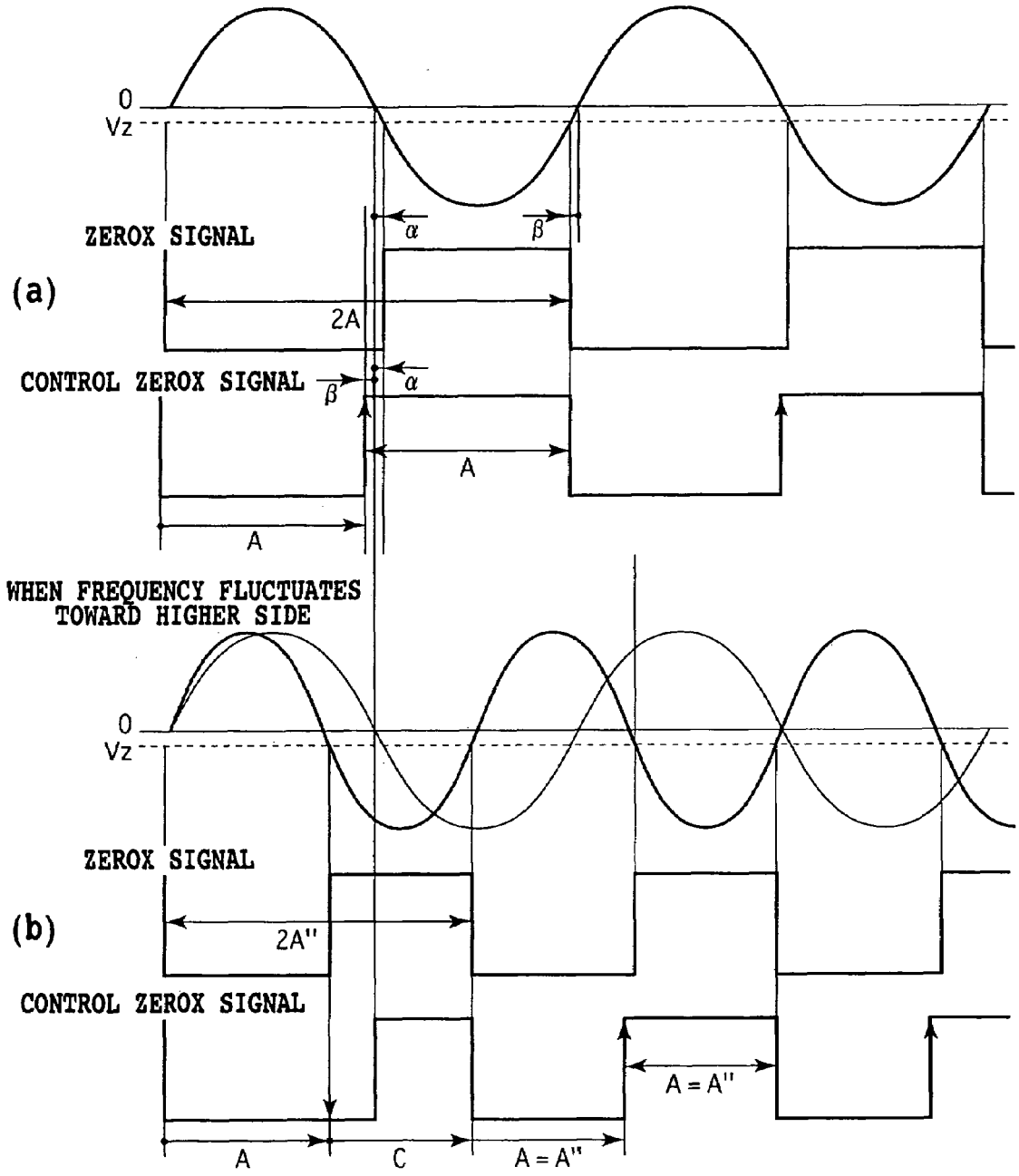
FIG. 10 is a diagram illustrating an outline of a ZEROX signal and control operation of an engine controller in the second embodiment accordance with the present invention.

FIG. 9 shows the zero-crossing detecting circuit 51 of the present embodiment; and FIG. 10 illustrates an outline of the ZEROX signal and the control operation in the engine controller 126.

The AC power supply 1 is supplied to a transistor 77 via a rectifier diode 83 and current limiting resistors 72 and 73. The rectifier diode 83 can be short-circuited. The resistor 76 is a base-emitter resistor of the transistor 77. The reference numeral 75 designates a capacitor for eliminating noise from the AC power supply 1. The resistor 73 can be short-circuited.

The reference numeral 79 designates a photocoupler for establishing a creeping distance between primary and secondary. The primary side power supply Vcc is connected to the transistor 77 and the light-emitting side of the photocoupler 79 via the current limiting resistor 78. The reference numeral 80 designates a current limiting resistor of the output transistor of the photocoupler 79. The output of the photocoupler 79 is supplied to the engine controller 126 as the ZEROX signal via a capacitor 82 and a resistor 81 constituting a filter.

When the Neutral side potential differs from the Common potential by an amount smaller than the threshold voltage Vz determined by the diode bridge rectifier 52, diode 83, resistors 72, 73 and 76, capacitor 75 and transistor 77, that is, when the Hot side potential is higher than the Neutral potential, or the Neutral potential is smaller than the threshold voltage Vz, the transistor 77 is brought out of conduction, the photocoupler 79 is brought into conduction, and the ZEROX signal is placed at a low level. In contrast, when the Neutral potential differs from the Common potential by an amount greater than the threshold voltage Vz, that is, when the Neutral side potential is lower than the Hot side potential, and the Neutral side potential is greater than the threshold voltage Vz, the transistor 77 is brought into conduction, the photocoupler 79 is brought out of conduction, and the ZEROX signal becomes a high level. In other words, the ZEROX signal is a pulse signal that changes its level according to whether the Neutral side potential differs from the Hot side potential by an amount greater or less than the threshold voltage Vz. However, the rising edge of the ZEROX signal that occurs when the Neutral potential differs from the Common potential by an amount less than the threshold voltage Vz lags behind the true zero-crossing point by a time period $\alpha$. In addition, the falling edge of the ZEROX signal that occurs when the Neutral potential differs from the Common potential by an amount greater than the threshold voltage Vz shifts previously to the true zero-crossing point by a time period $\beta$. Using the ZEROX signal without change as the trigger signal of the phase control, the time period $(\alpha+\beta)$ becomes the phase deviation for either the positive or negative polarity of the input power supply.

In the present embodiment, the engine controller 126 measures the one period (2A) of the falling signal of the ZEROX signal, and calculates half the time period A. Then, the engine controller 126 generates pseudo-rising edges after the time period A from the falling edges of the ZEROX signal in later periods, and generates a control ZEROX signal from the falling edges of the ZEROX signal and the pseudo-rising edges. The engine controller 126 carries out the phase control using the control ZEROX signal as the trigger signal. More specifically, the engine controller 126 employs the time period A as the basic time period in the phase control, and compares the time period A with a phase angle $\gamma$ calculated from a determined power ratio D. Thus, the engine controller 126 determines the time to send out the ON1 or ON2 signal, and carries out the phase control by sending out the ON1 or ON2 signal after that time has elapsed from the edges of the control ZEROX signal.

As for the control ZEROX signal, both the rising edge and falling edge shift previously to the true zero-crossing point by the time periods, and hence it has no phase deviation between the positive and negative polarities of the input power supply. As a result, it can achieve stable phase control. As for the edges of the control ZEROX signal, they are always previously to the true zero-crossing point. Accordingly, utilizing the edges makes it possible to prevent a pulse spreading across the true zero-crossing point from being sent out owing to the ON1 and ON2 pulse signal even when the control phase angle of the phase control is large, thereby being able to prevent erroneous ignition in the next cycle.

In addition, the engine controller can cope with the fluctuations of the power supply frequency during the control as follows. Specifically, when the power supply frequency fluctuates in the lower direction, the engine controller carries out the same sequence as in the embodiment 1 (steps S21-S26 and S33-S38 of FIG. 11 which will be described later), whereas when the power supply frequency fluctuates in the higher direction, the engine controller carries out the control by the following sequence.

When the rising edge of the ZEROX signal is detected before the rising edge of the control ZEROX signal which is generated after the time period A from the falling edge of the ZEROX signal, the engine controller sets the time period until that detection as a new time period A. Then, the engine controller measures the time period C from the rising edge of the ZEROX signal to the next falling edge of the ZEROX signal, and sets half the sum of the new time period A and time period C, (A+C)/2, as the updated time period A. In this case, the time period (A+C) corresponds to one period of the power supply frequency, which is determined by only the interval between the falling edges of the ZEROX signal.

The present control enables the control with good trackability in spite of a great increase or decrease of the power supply frequency.

Figure 11:
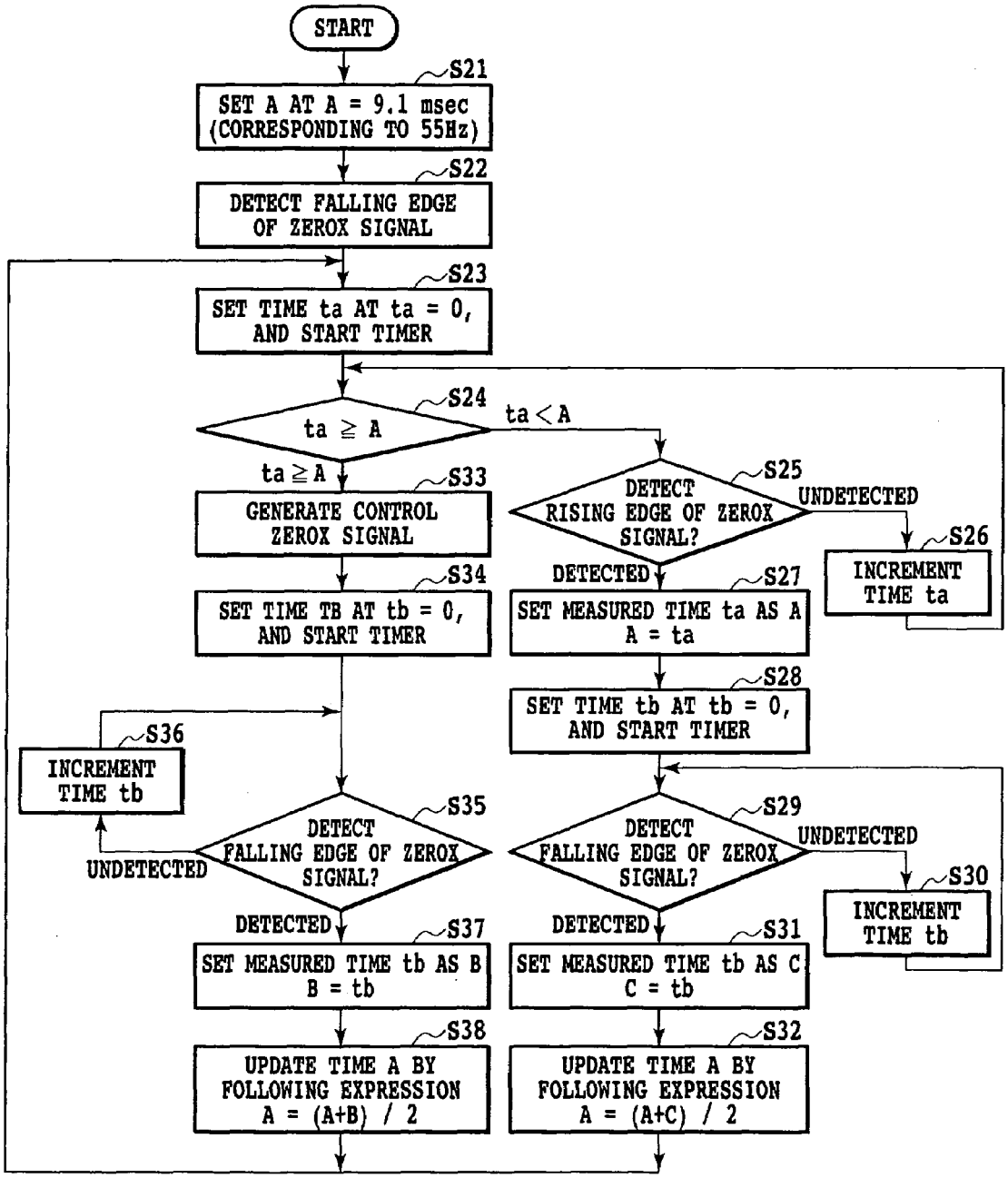
FIG. 11 is a flowchart illustrating a control sequence in the second embodiment in accordance with the present invention.

Subsequently, a flowchart illustrating a control sequence of the engine controller in the present embodiment is shown in FIG. 11 (the control procedure shown in the flowchart is stored in the ROM in the engine controller. This is the same to FIGS. 13 and 14 which will be described later).

The initial value of the time period A is set at a value within the range of the conceivable power supply frequency, at a time period corresponding to 55 Hz which is the median of the range from 40 Hz to 70 Hz, for example (S21). Thus, as half the period, the time period A is set at 9.1 msec. The engine controller 126 detects the falling edge of the ZEROX signal fed from the zero-crossing detecting circuit 51 (S22), places the time period ta=0, and starts the timer for measuring the time period A (S23). Until the time period ta becomes the time period A (S24), the timer increments the time period ta (S26). When the engine controller 126 detects the rising edge of the ZEROX signal fed from the zero-crossing detecting circuit 51 before the time period ta reaches the time period A (S25), it sets the time period ta up to that time as a new time period A (S27), and stops the increment of the time period ta. Subsequently, the engine controller 126 sets the time period tb at zero, and starts the timer for measuring the time period B (see FIG. 6) or time period C (S28). Until the engine controller 126 detects the falling edge of the ZEROX signal fed from the zero-crossing detecting circuit 51 (S29), the timer increments the time period tb (S30). When the engine controller 126 detects the falling edge of the ZEROX signal (S29), it sets the time period tb as the time period C (S31). Then, the engine controller 126 sets half the sum of the new time period A and time period C, (A+C)/2 as the updated time period A (S32). Then, returning to S23, the engine controller 126 repeats the sequence.

On the other hand, when the time period ta reaches the initially set time period A (S24) without detecting the rising edge of the ZEROX signal (S25), the engine controller 126 generates the pseudo-rising edge, thereby generating the control ZEROX signal (S33). Subsequently, the engine controller 126 sets the time period tb at zero, and starts the timer for measuring the time period B or time period C (S34). Until the engine controller 126 detects the falling edge of the ZEROX signal fed from the zero-crossing detecting circuit 51 (S35), the timer increments the time period tb (S36). When the engine controller 126 detects the falling edge of the ZEROX signal (S35), it sets the time period tb as the time period B (S37). Then, it sets half the sum of the initially set time period A and the time period B, (A+B)/2, as the updated time period A (S38), returns to step S23, and repeats the sequence.

As described above, according to the present embodiment, the engine controller generates, from the ZEROX signal fed from the zero-crossing detecting circuit, the symmetrical control ZEROX signal which has equal phase deviation from the true zero-crossing point for either positive or negative polarity of the AC input power supply. The phase control based on the control ZEROX signal enables the stable power control for the polarities of the input power supply, that is, enables the stable temperature control. Since the zero-crossing detecting circuit detects the zero cross using the half-wave rectification, it is applicable to a power supply having a waveform with a sharp power supply voltage gradient near the zero-crossing points such as a rectangular wave power supply output from an uninterruptible regulated power supply.

In addition, when the engine controller detects the rising edge of the ZEROX signal before the (initially set) time period A has elapsed from the falling edge of the ZEROX signal, at which the engine controller generates the rising edge of the control ZEROX signal, the engine controller sets the time period until the detection as the new time period A. Then, the engine controller measures the time period C from the rising edge of the ZEROX signal to the detection of the falling edge of the ZEROX signal. In contrast, when the engine controller does not detect the rising edge of the ZEROX signal until the (initially set) time period A has elapsed from the falling edge of the ZEROX signal, at which the engine controller generates the rising edge of the control ZEROX signal, the engine controller measures the time period B from the time, at which the time period A has elapsed and the rising edge of the control ZEROX signal is generated, to the detection of the falling edge of the ZEROX signal. Using the time period calculated from (A+B)/2 or (A+C)/2 as the updated time period A enables the trackability in spite of the frequency fluctuations, and the engine controller can carry out the power control, that is, the temperature control free from the effect of the power supply frequency fluctuations. In the present embodiment, the falling edge of the ZEROX signal is detected previously to the true zero-crossing point, and the rising edge of the ZEROX signal is detected behind the true zero-crossing point. Accordingly, the rising edge of the control ZEROX signal is generated before the true zero-crossing point, and without the frequency fluctuations, the rising edge of the control ZEROX signal is always generated previously to the rising edge of the ZEROX signal. Thus, the present embodiment enables the detection method even though the frequency fluctuates in the higher direction. Furthermore, even though the control phase angle of the phase control is large, the present embodiment can prevent the pulse spreading across the true zero-crossing point from being sent out owing to the ON1 and ON2 pulse signals, thereby being able to prevent the error ignition in the next cycle. Moreover, to prevent the erroneous detection by such zero-crossing detecting circuits as proposed by the foregoing References 19 and 20, a sequence is carried out which ignores the zero-crossing signal under certain conditions. In this case, the sequence of the embodiment 1 sometimes cannot detect the falling edge of the ZEROX signal to be normally detected during the measurement of the time period B from the rising edge of the control ZEROX signal when the frequency fluctuates towards the higher direction. However, carrying out the sequence (steps S25 and S27-S32) of the present embodiment 2 makes it possible to more positively detect the falling edge of the ZEROX signal to be normally detected, even if the frequency fluctuates towards the higher direction. Thus, the present embodiment 2 can cope with the greater fluctuations of the power supply frequency, and carry out the power control free from the fluctuations of the power supply frequency, that is, the stable temperature control.

Figure 12:
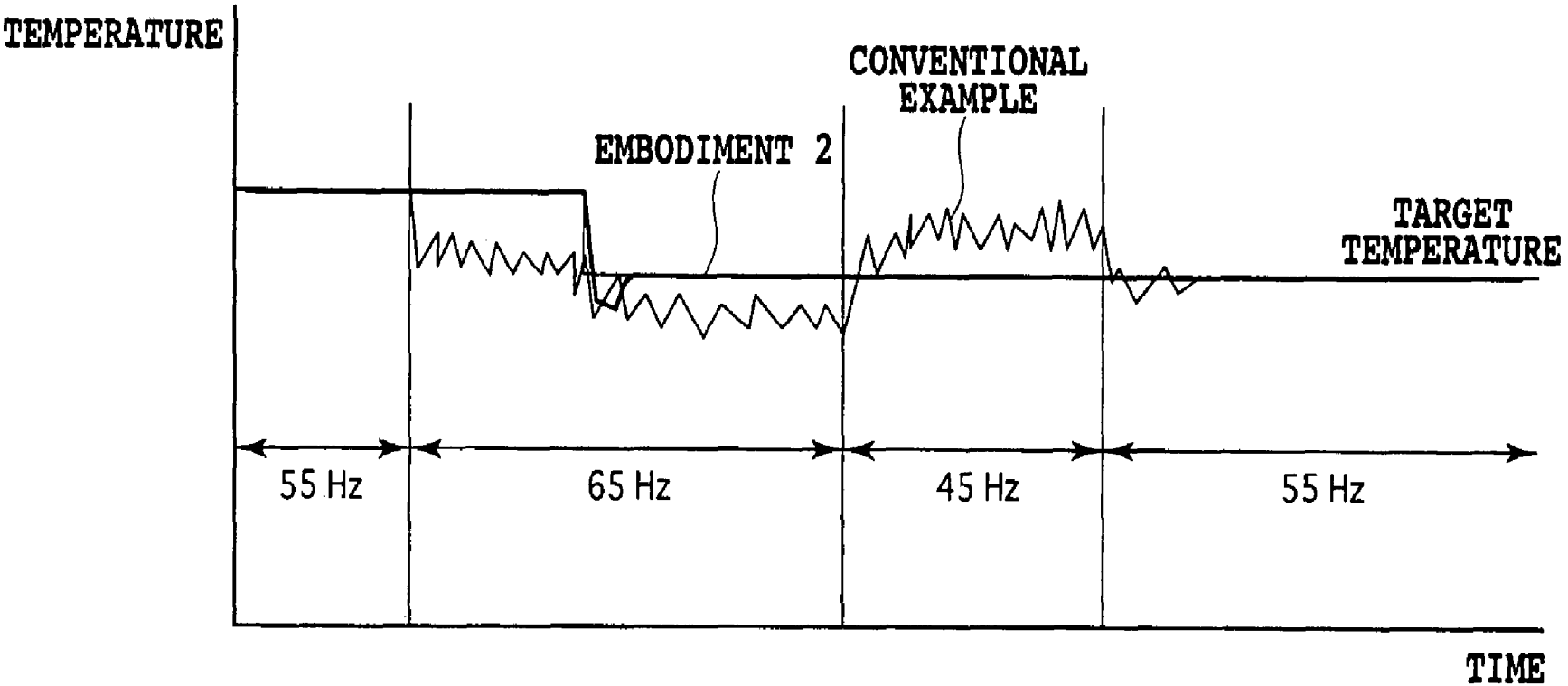
FIG. 12 is a diagram illustrating main points of the temperature control of the second embodiment in accordance with the present invention.

FIG. 12 schematically illustrates in comparison with a conventional example an outline of the temperature control in the embodiment 2 in accordance with the present invention when the frequency fluctuates. FIG. 12 clearly shows that the present invention can achieve more stable temperature control than the conventional example.

Incidentally, similar control is possible even when only one heating element is used, or the direction of the edge detection of the ZEROX signal is made in the opposite direction.

Embodiment 3

The present embodiment, which employs the circuit of FIG. 8, differs from the second embodiment in part of the control sequence (since it is the same as the second embodiment up to steps S21-S30 and S33-S37, their description is omitted here), and duplicate description of the first and second embodiments may be omitted.

Figure 13:
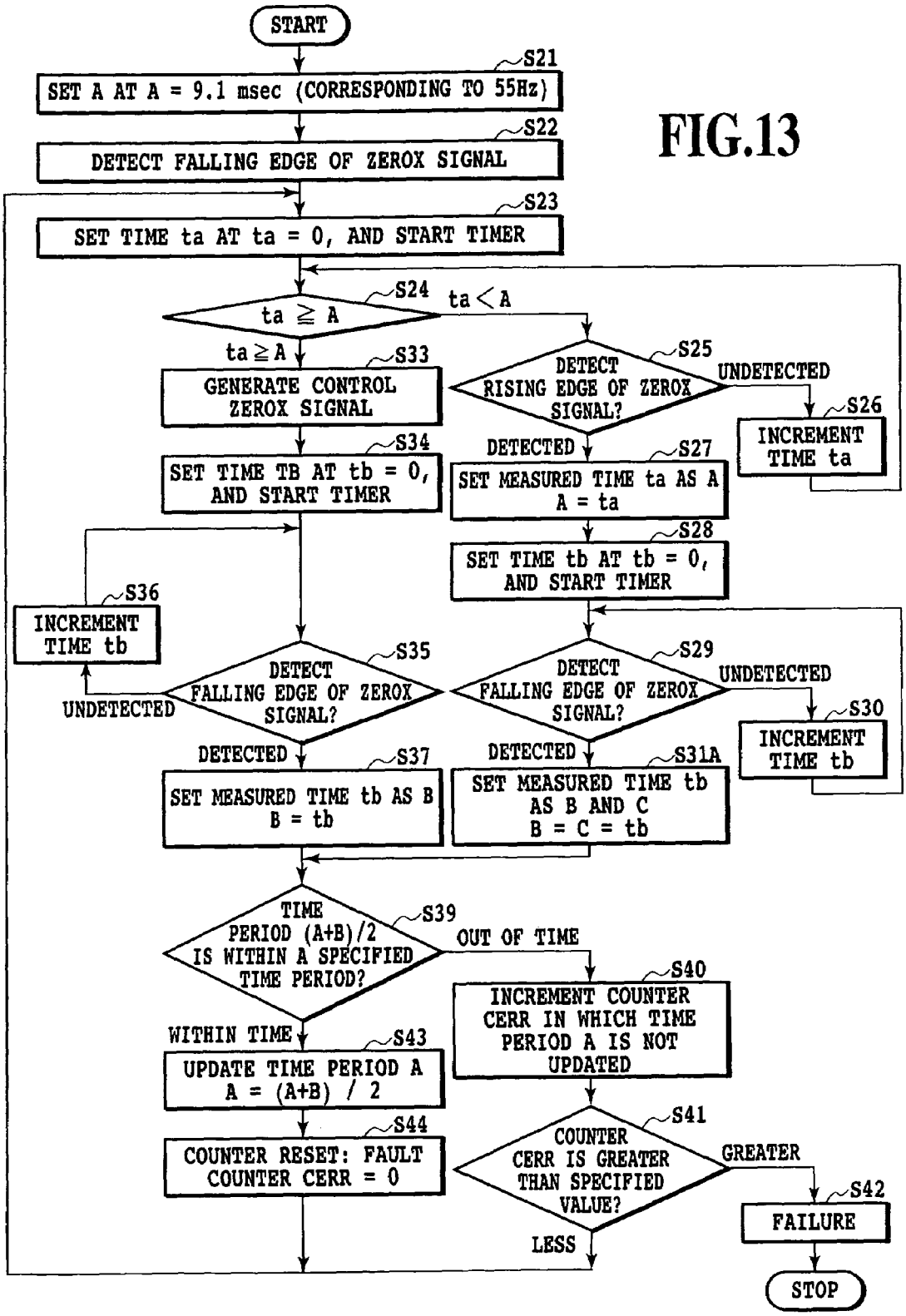
FIG. 13 is a flowchart illustrating a control sequence in a third embodiment in accordance with the present invention.

FIG. 13 shows a flowchart illustrating a control sequence in accordance with the present invention.

Detecting the falling edge of the ZEROX signal at S29, the engine controller sets the time period tb as the time periods C and B (S31A), and shifts the control to step S39.

In addition, after setting the time period tb as the time period B at step S37, the engine controller shifts the control to step S39.

At step S39, the engine controller makes a decision as to whether the time period (A+B)/2 is within a specified time period, that is, within an expected power supply frequency range such as within a time period 12.5-7.1 msec corresponding to 40-70 Hz. if it is within a specified time period, the engine controller updates the time period A from (A+B)/2 to the time period calculated (S43). Then, the engine controller resets the fault counter CERR to zero (S44), and returns to step S23 to repeat the sequence.

If the decision is made that the time period (A+B)/2 is out of the specified time period at step S39, the engine controller does not update the time period A, and increments the fault counter CERR (S40). If the fault counter CERR has a value greater than a specified value (S41), the engine control makes a decision that the power supply is abnormal, or the zero-crossing detecting circuit is faulty (S42), and halts the power supply to the heating elements (3 and 20) by turning off the triacs. When the fault counter CERR has a value equal to or less than the specified value (S41), the engine controller shifts the control to step S23 to repeat the sequence.

As in the present embodiment, when the time period calculated from (A+B)/2 is out of the time period range corresponding to the specified frequency range, the time period A is not updated. This makes it possible to prevent incorrect detection of the zero-crossing detecting circuit, or to ignore unexpected noise, thereby enabling the power control impervious to the effect of external perturbations superimposed on the power supply voltage and the like.

In addition, when it is out of the specified frequency range for more than the specified time period continuously, a decision is made that a fault occurs. This makes it possible to prevent the operation under instable conditions, and a damage to the fuser which can be caused by overheating of the heater or excessive lack of power.

Embodiment 4

The present embodiment, which also employs the circuit of FIG. 8, differs from the second embodiment in part of the control sequence. The duplicate description of the first, second and third embodiments may be omitted here.

Figure 14:
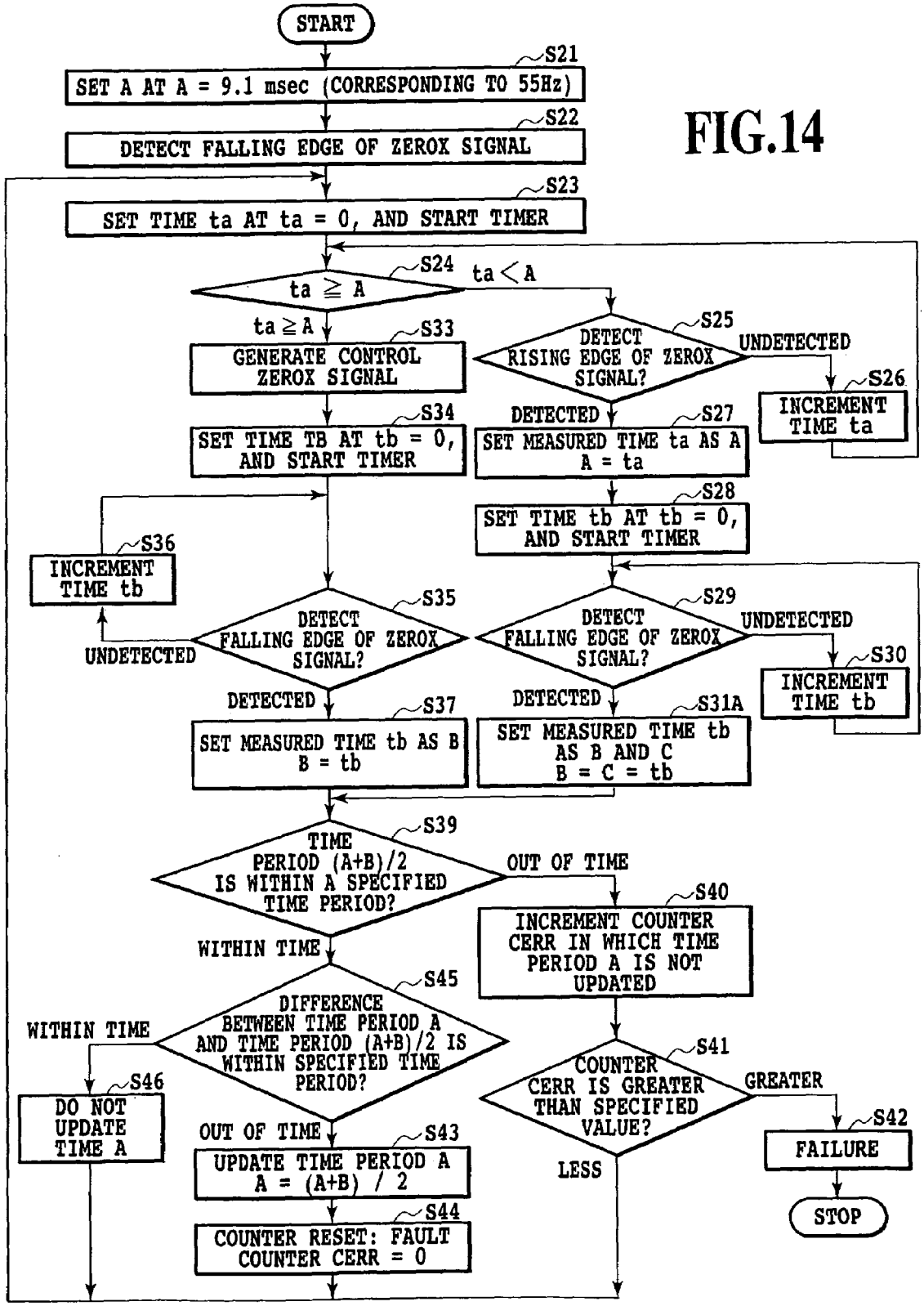
FIG. 14 is a flowchart illustrating a control sequence in a fourth embodiment in accordance with the present invention.

FIG. 14 shows a flowchart illustrating a control sequence in accordance with the present invention.

Since the processing from step S21 to S37 and from step S39 to S44 is the same as that of the third embodiment, the description thereof is omitted here. When (A+B)/2 is within the specified time period at step S39, the processing proceeds to step S45. If the difference between the time period calculated from (A+B)/2 and the time period A is less than a specified time period, less than about 0.2 msec corresponding to 1 Hz, for example (S45), the engine controller does not update the time period A (S46), and returns the processing to step S23. On the other hand, if the difference between the time period calculated from (A+B)/2 and the time period A is greater than the specified time period (S45), the engine controller makes a decision that the power supply frequency detected fluctuates, and updates the time period A (S43).

As in the present embodiment, the time period A is updated only when the difference between the time period calculated from (A+B)/2 and the time period A is greater than the specified time period. This makes it possible to ignore the effect of minute fluctuations of the power supply voltage, or the effect of variations in the zero-crossing detecting circuit, thereby being able to carry out the stable power control, that is, the stable temperature control.

The present invention has been described in detail with respect to preferred embodiments, and it will now be that changes and modifications maybe made withoud departing from the invention in its broader aspects, and it is the intention, therefore, in the appended claims to cover all such changes and modifications as fall within the true spirit of the invention.

This application claims priority from Japanese Patent Application No. 2004-317062 filed Oct. 29, 2004, which is hereby incorporated by reference herein.

What is claimed is:

1. A power supply apparatus comprising:

a voltage detecting section for outputting a first pulse signal which is at a first voltage level when an AC power supply voltage is below a specified threshold value, and at a second voltage level when the AC power supply voltage exceeds the specified threshold value; and a power control section for controlling supplied power in response to the first pulse signal fed from said voltage detecting section, wherein said power control section successively measures a period of an edge in one direction of the first pulse signal fed from said voltage detecting section, sets a set time period at a time period equal to half the period of the edge in one direction, and controls a switching device for switching between turning-on and turning-off of said AC power supply in accordance with timing of the edge in one direction and timing when the set time period has elapsed after the edge in one direction.

2. The power supply apparatus as claimed in claim 1, wherein if a time period equal to half the measured period is out of a range of a preset time period, said power control section does not update the set time period.

3. The power supply apparatus as claimed in claim 2, wherein if the edge in the other direction is detected before the set time period has elapsed after the edge in one direction, said power control section updates the set time period to a time period from the edge in one direction to the edge in the other direction.

4. The power supply apparatus as claimed in claim 3, wherein if a time period difference between the set time period and a time period equal to half newly measured period is within the preset time period, said power control section does not update the set time period.

5. The power supply apparatus as claimed in claim 2, wherein said power control section halts the power supply if a time period equal to half the measured period is out of the range of the preset time period continuously for more than a specified time period.

6. The power supply apparatus as claimed in claim 1, wherein if a time period difference between the set time period and a time period equal to half newly measured period is within the preset time period, said power control section does not update the set time period.

7. The power supply apparatus as claimed in claim 6, wherein if the edge in the other direction is detected before the set time period has elapsed after the edge in one direction, said power control section updates the set time period to a time period from the edge in one direction to the edge in the other direction.

8. The power supply apparatus as claimed in claim 1, wherein said power control section carries out phase control of the supplied power.

9. The power supply apparatus as claimed in claim 1, wherein said voltage detecting section outputs the first pulse signal in accordance with a lower-potential-side output potential of a voltage of a rectification circuit for carrying out full-wave rectification of said AC power supply and one line voltage of said AC power supply.

10. The power supply apparatus as claimed in claim 1, wherein said voltage detecting section outputs the first pulse signal in accordance with two line voltages of said AC power supply.

11. An image forming apparatus including an image forming section for forming a toner image on a recording medium, and a fuser for fusing the toner image on the recording medium by heating the toner image, wherein said fuser comprises:

heating means including a heating element;

temperature detecting section for detecting temperature of said heating means; and a power supply apparatus which supplies power to the heating element of said heating means for heating, and wherein said power supply apparatus comprises:

a voltage detecting section for outputting a first pulse signal which is at a first voltage level when an AC power supply voltage is below a specified threshold value, and at a second voltage level when the AC power supply voltage exceeds the specified threshold value; and a power control section for controlling supplied power in response to the first pulse signal fed from said voltage detecting section, wherein said power control section successively measures a period of an edge in one direction of the first pulse signal fed from said voltage detecting section, sets a set time period at a time period equal to half the period of the edge in one direction, and controls a switching device for switching between turning-on and turning-off of said AC power supply in accordance with timing of the edge in one direction and timing when the set time period has elapsed after the edge in one direction.

* * * * *

UNITED STATES PATENT AND TRADEMARK OFFICE

CERTIFICATE OF CORRECTION

PATENT NO. : 7,310,486 B2 
APPLICATION NO. : 11/255102
DATED : December 18, 2007
INVENTOR(S) : Takao Kawazu et al.

It is certified that error appears in the above-identified patent and that said Letters Patent is hereby corrected as shown below:

COLUMN 5
Line 8, “such far” should read --so far--.
Line 9, “disables” should read --it disables--.
Line 14, “misdetection-even” should read --misdetection even--.
Line 29, “that is” should read --there is--.
Line 35, “anda power” should read --and a power--.
Line 44, “deirection” should read --direction--.
Line 60, “half newly” should read --half the newly--.
Line 64, “edge-in” should read --edge in--.

COLUMN 6
Line 2, “half newly” should read --half the newly--.
Line 38, “deirection” should read --direction--.

COLUMN 7
Line 9, “such far” should read --so far--, and “disables” should read --it disables--.
Line 64, “accordance” should read --in accordance--.

COLUMN 8
Line 35, “a pair” should read --a pair of--.
Line 37, “papers” should read --paper S--, and “pair” should read --pair of--.

COLUMN 12
Line 12, “case maybe.” should read --case may be.--.

COLUMN 15
Line 60, “periods,” should read --period β,--.
Line 64, “previously” should read --previous--.

COLUMN 18
Line 44, “Hz. if should read --Hz. If--.

UNITED STATES PATENT AND TRADEMARK OFFICE

CERTIFICATE OF CORRECTION

PATENT NO. : 7,310,486 B2
APPLICATION NO. : 11/255102
DATED : December 18, 2007
INVENTOR(S) : Takao Kawazu et al.

It is certified that error appears in the above-identified patent and that said Letters Patent is hereby corrected as shown below:

COLUMN 19
Line 41, “now be that” should read --now be seen that--.
Line 42, “maybe” should read --may be--, and “withoud” should read --without--.

COLUMN 20
Line 18, “half newly” should read --half the newly--.
Line 30, “half newly” should read --half the newly--.

Signed and Sealed this

Twenty-fourth Day of March, 2009

JOHN DOLL
*Acting Director of the United States Patent and Trademark Office*